US006855213B2

(12) United States Patent
Yoshitake et al.

(10) Patent No.: US 6,855,213 B2
(45) **Date of Patent: *Feb. 15, 2005**

(54) NON-RIDGING FERRITIC CHROMIUM ALLOYED STEEL

(75) Inventors: Eizo Yoshitake, Middletown, OH (US); Alan R. McKague, Monroe, OH (US)

(73) Assignee: Armco Inc., Middletown, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/153,822

(22) Filed: Sep. 15, 1998

(65) Prior Publication Data

US 2001/0013382 A1 Aug. 16, 2001

(51) Int. Cl.[7] ..... C21D 8/02; C22C 38/28

(52) U.S. Cl. ..... 148/325; 148/542; 148/547; 148/609; 148/608; 420/70

(58) Field of Search ..... 48/325, 542, 547, 48/608, 609; 420/70

(56) References Cited

U.S. PATENT DOCUMENTS

| | | | | |
|---|---|---|---|---|
| 3,250,610 A | | 5/1966 | Lula et al. | |
| 3,308,515 A | | 3/1967 | Turnball et al. | |
| 3,936,323 A | | 2/1976 | Kazeva | |
| 3,997,373 A | | 12/1976 | Kazeva | |
| 4,070,208 A | | 1/1978 | Hayami et al. | |
| 4,465,525 A | | 8/1984 | Yoshimura et al. | 148/37 |
| 4,515,644 A | | 5/1985 | Sawatani et al. | 148/12 |
| 4,629,504 A | | 12/1986 | Koike et al. | |
| 4,709,742 A | | 12/1987 | Harase et al. | |
| 4,834,808 A | | 5/1989 | Hill | |
| 4,964,926 A | | 10/1990 | Hill | 148/325 |
| 5,350,559 A | | 9/1994 | Miyazaki et al. | |
| 5,405,575 A | | 4/1995 | Yazawa et al. | |
| 5,462,611 A | | 10/1995 | Uematsu et al. | 148/325 |
| 5,462,615 A | | 10/1995 | Von Hagen et al. | |
| 5,489,345 A | | 2/1996 | Koike et al. | 148/325 |
| 5,492,575 A | | 2/1996 | Teraoka et al. | 148/542 |
| 5,505,797 A | | 4/1996 | Yokota et al. | 148/610 |
| 5,512,239 A | | 4/1996 | Fujiwara et al. | |
| 5,662,864 A | | 9/1997 | Kato et al. | 420/70 |
| 5,709,836 A | | 1/1998 | Fujisawa et al. | |
| 5,769,152 A | | 6/1998 | Yamada | 164/476 |
| 5,868,875 A | * | 2/1999 | Yoshitake et al. | 148/542 |

FOREIGN PATENT DOCUMENTS

| | | |
|---|---|---|
| EP | 0750051 A1 | 12/1996 |
| EP | 0765941 A1 | 4/1997 |

(List continued on next page.)

OTHER PUBLICATIONS

W.J. Poole, et al, Inoculating Stainless Steel w/Titanium Nitrate Jun. 1997, pp. 173–182.

(List continued on next page.)

*Primary Examiner*—Deborah Yee
(74) *Attorney, Agent, or Firm*—Larry A. Fillnow

(57) ABSTRACT

A ferritic non-ridging stainless steel and process therefor. A chromium alloyed steel melt containing sufficient titanium and nitrogen but a controlled amount of aluminum is cast into an ingot or continuously cast into a strip or a slab having an as-cast fine equiaxed grain structure substantially free of columnar grains. The as-cast steel contains 0.08% C, at least about 8% Cr, up to 1.50% Mn, <0.020% Al, ≦0.05% N, ≦1.5% Si, <2.0% Ni, Ti≧0.10%, the ratio of (Ti×N)/Al≧0.14, all percentages by weight, the balance Fe and residual elements. Preferably, the titanium is controlled so that (Ti/48)/[(C/12)+(N/14)]>1.5. A hot processed sheet may be formed from a continuously cast slab without grinding the surfaces of the slab. The hot processed sheet may be descaled, cold reduced to a final thickness and recrystallization annealed. Annealing the hot processed sheet prior to cold reduction is not required to obtain an annealed sheet essentially free of ridging and having high formability.

27 Claims, 8 Drawing Sheets

FOREIGN PATENT DOCUMENTS

| | | | | |
|---|---|---|---|---|
| EP | 785283 | | 7/1997 | ..... C21C/7/06 |
| JP | 57070223 | A | 4/1982 | |
| JP | 570702225 | A | 4/1982 | |
| JP | 02258931 | | 10/1990 | |
| JP | 08238545 | A | 9/1996 | |
| JP | 08239731 | A | 9/1996 | |
| JP | 08281394 | A | 10/1996 | |
| JP | 09024439 | A | 1/1997 | |
| JP | 09024440 | A | 1/1997 | |
| JP | 09143569 | A | 6/1997 | |
| JP | 09256064 | A | 9/1997 | |
| JP | 09256065 | A | 9/1997 | |
| JP | 316542 | | 12/1997 | ..... C22C/38/00 |

OTHER PUBLICATIONS

Ostrowski et al., *Influence of Alloying Elements on the as–cast Structure of 17*
Chromium Stainless Steels, Scandinavian J. Metallurgy, 8 (1979) 177–184.

Bramfitt B.L., "The Effect of Carbide and Nitride Additions on the Heterogeneous Nucleation Behavior of Liquid Iron," *Met Trans*., vol. 1, No. 7, pp. 1987–1995, Jul. 1970.

Chatterjee M., M.S.N Balasubramanian, K.M. Gupt, and P. Krishna Rao, "Inoculation During Electroslag Remelting of 15CDV6 Steel," *Ironmaking and Steelmaking*, vol. 17, No. 1, pp. 38–42, 1990.

Church, N., Wiser P. and Wallace J.F., "Control of Cast Grain Size of Steel Castings, Effect of Grain Refinement on Properties," *Modern Castings*, pp. 129–144, Apr. 1996.

Garland, J.G., "Weld Pool Solidification Control," *Metal Construction*, vol. 6, No. 4, pp. 121–127, Apr. 1974.

Granier A., Chatillon C., Allibert M.A., "High Temperature Mass Spectrometric Study of the Thermodynamics of Solid Titanium Oxides: Activities of Ti and TiO in the Range 0.47<O/Ti<1.40," *High Temperature Science*, vol. 23, pp. 115–145, 1987.

Granier A., Chatillon C., Allibert M., "Thermodynamic Activities in the Cubic Phase Ti–O–N by High Temperature Mass Spectrometry," *Journal of the American Ceramic Society*, vol. 65, No. 10, pp. 465–469, Oct. 1982.

Granier A., Renard R. and Coutures J.P., "Le Diagramme de Phase Ternaire Ti–O–N: Etude de la Solution Solide Cubique TiO–TiN," *Rev. int. hautes Tempér. Réfract., Fr*., vol. 17, pp. 235–247, 1980.

Härkki, J., "A Literature Survey on First–Order Interaction Coefficients in Ferrous Alloys," Helsinki University of Technology, Institution of Process Metallurgy, Finland, ISBN 951–752–909–0, pp. 1–46. Oct. 31, 1985.

Heintze G.N. and McPherson R., "Grain Refinement of Steels by Titanium Inoculation During Submerged Arc Welding," *Australian Welding Journal*, Spring Ed., pp. 37–41, 1983.

Heintze G.N., "Grain Refinement of Steels During Submerged Arc Welding—A Fundemental Study," *Australian Welding Research*, Dec. Ed., pp. 32–44, 1984.

Heintze G.N. and McPherson R., "The Role of Titanium and Aluminum Additions on the Solidification Structure of Steels," Proc. 1985 Metals Congress, Ballarat, Victoria, Australia, pp. 13–17, May 1985.

Heintze G.N. and Mcpherson R., "Solidification Control of Submerged Arc Welds in Steels by Inoculation with Ti," *Welding Research Supplement*, pp. 73–82, Mar. 1986.

Kerr H.W., "Solidification and Grain Structures in Wleds," *Conf. Proc: International Trends in Welding Science and Technology*, Gatlinberg, Tenn USA Jun. 1–5, 1992, ASM Metals Park OH USA pp. 157–166, 1993.

O'Malley R.J., "Casting Technologies For Direct Hot Charging at Armco Mansfield," *Steel Times International*, pp. 12–13, Jan. 1998.

Ostrowski A. and Langer E.W., "Influence of Alloying Elements on the As–Cast Structure of 17% Chromium Stainless Steels," *Scandinavian Journal of Metallurgy*, vol. 8, pp. 177–184, 1979.

Ostrowski A. and Langer E.W., "Precipitation of Titanium Carbonitrides in As–Cast 17% Chromium Stainless Steels," *Scandinavian Journal of Metallurgy*, vol. 8, pp. 153–160, 1979.

Rajaniemi M., "Thermodynamics of Titanium Nitride Formation in Stainless Steel and Its Effects on Clogging During Casting," Scaninject Conference VI.International Conference on Refining Processes.II, Lulea, Sweden, Jun. 2–4, 1992.

Turnbull G.K., Patton D.M., Form G.W. ,and Wallace J.F., "Grain Refinement of Steel Castings and Weld Deposits," *Trans. Am. Foundrymen's Soc*., vol. 69, pp. 792–804, 1961.

Villafuerte J.C., Pardo E., and Kerr H.W., "The Effect of Alloy Composition and Welding Conditions on Columnar–Equiaxed Transitions in Ferritic Stainless Steel Gas–Tungsten Arc Welds," *Met. Trans. A*., vol. 21A, No. 7, pp. 187–191,Jul. 1990.

Villafuerte J.C. and Kerr H.W., "Electromagnetic Stirring and Grain Refinement in Stainless Steel GTA Welds," *Welding, Journal*., vol. 69, No. 1, pls–13s, Jan. 1990.

Villafuerte J.C. and Kerri H.W., "The Effect of Abrasive Cleaning on Columnar–to–Equiaxed Transition in Ferritic Stainless Steel GTA Welds," *Conf. Proc: International Trends in Welding Science and Technology*, Gatlinberg Tenn. USA Jun. 1–5, 1992, ASM Metals Park OH USA, pp. 187–191, 1993.

Villafuerte J.C., "Columnar to Equiaxed Transitions in Gas Tungsten Arc Weld Pool Solidification of Ferritic Stainless Steels," PhD Thesis, U. Waterloo, Ontario, Canada, 311 pp. 1993.

Villafuerte J.C., Kerr H.W., and David S.A., "Mechanisms of Equiaxed Grain Formation in Ferritic Stainless Steel Gas Tungsten Arc Welds," *Mat. Sci, & Eng. A*, VA194, 1995.

Villafuerte J.C. ,"The Effects of Composition and Electromagnetics Stirring on Columnar–Equiaxed Transitions in Stainless Steel GTA Welds," M.S. Thesis, U. Waterloo, Waterloo, Ontario, Canada, 195 pp., 1988.

Wieser P.F. ,Wallace J.F. , and Church N., "Grain Refinement of Steel Castings," *Journal of Metals*, vol. 48, No. 6, pp. 44–51, Jun. 1967.

Wriedt, H.A., and Murray J.L., "The N–Ti (Nitrogen–Titanum) System," *Bulletin of Alloy Phase Diagrams*, vol. 8, No. 4, pp. 378–388, 1987.

* cited by examiner

NON-RIDGING FERRITIC CHROMIUM ALLOYED STEEL

BACKGROUND OF THE INVENTION

This invention relates to a ferritic chromium alloyed steel formed from a melt having an as-cast fine equiaxed grain structure. More particularly, this invention relates to a ferritic chromium alloyed steel formed from a melt containing sufficient titanium and nitrogen but a controlled amount of aluminum for forming small titanium oxide inclusions to provide the necessary nuclei for forming the as-cast equiaxed grains. A hot processed sheet produced from the steel having this equiaxed cast grain structure is especially suitable for producing a cold reduced, recrystallization annealed sheet having excellent non-ridging characteristics and stretch formability, even without a hot band anneal or intermediate anneal.

It is desirable for a highly formable ferritic stainless steel, in addition to having a high plastic strain ratio, to minimize a phenomenon known as "ridging", "roping" or "ribbing". Unlike austenitic stainless steel, unsightly ridging may appear on the surfaces of a cold reduced, recrystallization annealed ferritic stainless steel sheet after being cold formed into a part. Ridging is characterized by the formation of ridges, grooves or corrugations which extend parallel to the rolling direction of the sheet. This defect not only is detrimental to the surface appearance of the sheet but also results in inferior stretch formability.

Ferritic chromium alloyed steels, especially sub-equilibrium ferritic chromium alloyed steels such as stainless Type 409 and 439, regardless of whether continuously cast into slab thicknesses of 50–200 mm or strip cast into thicknesses of 2–10 mm, typically have as-cast large columnar grains. These large columnar grains have a near cube-on-face crystallographic texture which leads to a very undesirable ridging characteristic in a final cold rolled, annealed sheet used in various fabricating applications. The surface appearance resulting from this ridging is highly objectionable in exposed formed parts such as caskets, automotive trim, exhaust tubes and end cones, stamped mufflers, oil filters, and the like. Ridging causes the sheet to have a rough, uneven surface appearance after forming and is attributed to a large non-uniform or "banded" grain structure present after cold rolling and annealing, resulting from the initial occurrence of the columnar grain structure in the as-cast steel.

To minimize the occurrence of ridging, additional expense is incurred by annealing a hot rolled sheet prior to cold reduction. This additional annealing step of hot rolled ferritic stainless steel also results in reduced formability caused by lower average strain ratios, i.e., $R_m$, which degrades deep drawability. A hot rolled sheet that is annealed before cold reduction must be cold reduced at least 70% to offset the loss of $R_m$ caused by the hot band anneal before final annealing.

Over the years, there have been numerous attempts to obviate the above mentioned processing requirements and expense to eliminate ridging by modifying the alloy composition of ferritic stainless steel. It is known ridging in a ferritic stainless steel originates primarily during hot rolling. There have been attempts to minimize ridging by forming a fine equiaxed grain structure in a cast ingot by controlling the chemistry of the melt, e.g., one or more of the impurities of C, N, O, S, P, and by refining grain structure by using lower hot rolling temperatures, e.g., 950–1100° C. Chemistry control during refining has produced some improved ridging characteristics for ferritic stainless steels because of the formation of a second phase, i.e., austenite at elevated temperatures which becomes martensite at room temperature. However, formation of this second phase has been at the expense of tensile elongation and welding performance of the final products. Temperature control during hot rolling has resulted in operational difficulties as well since higher hot rolling power is required. Accordingly, hot roll sheet thicknesses must be greater. Hot rolling then must be followed by cold rolling in at least two stages with a second intermediate anneal between the two cold rollings.

U.S. Pat. No. 5,769,152 recognizes columnar grains are not desirable in continuously cast stainless steel. This patent suggests columnar grains can be prevented and equiaxed grains formed instead by casting molten steel using a low super heat temperature of 0–15° C. above the liquidus and magnetically stirring the molten steel in a casting mold.

Others have attempted to eliminate ridging by modifying an alloy composition of ferritic stainless steel by the addition of one or more stabilizing elements. U.S. Pat. No. 4,465,525 relates to a ferritic stainless steel having excellent formability and improved surface quality. This patent discloses that boron in amounts of 2–30 ppm and at least 0.005% aluminum can increase the elongation and the $R_m$ as well as decrease the ridging characteristic. U.S. Pat. No. 4,515,644 relates to a deep drawing ferritic stainless steel having improved ridging quality. This patent discloses that an addition of aluminum, boron, titanium, niobium, zirconium and vanadium all can increase ferritic stainless steel elongation, increase the $R_m$ and enhance the anti-ridging property. More specifically, this patent discloses a ferritic stainless steel having at least 0.01% Al that has improved anti-ridging characteristics. U.S. Pat. No. 5,662,864 relates to producing a ferritic stainless steel having good ridging characteristics when Ti, C+N and N/C are carefully controlled. This patent teaches ridging can be improved due to formation of carbonitrides by adding Ti in response to the C+N content in a melt. The steel melt contains $\leqq 0.01\%$ C, $\leqq 1.0\%$ Mn, $\leqq 1.0\%$ Si, 9–50% Cr, $\leqq 0.07\%$ Al, $0.006 \leqq C+N \leqq 0.025\%$, $N/C \geqq 2$, $(Ti-2S-3O)/(C+N) \leqq 4$ and $Ti \times N \leqq 30 \times 10^{-4}$. U.S. Pat. No. 5,505,797 relates to producing a ferritic stainless steel having reduced intra-face anisotropy and an excellent grain structure. This patent teaches good ridging characteristics are obtained when the steel melt preferably contains 0.0010–0.080% C, 0.10–1.50% Mn, 0.10–0.80% Si, 14–19% Cr and two or more of 0.010–0.20% Al, 0.050–0.30% Nb, 0.050–0.30% Ti and 0.050–0.30% Zr. The steel is cast into a slab and hot rolled to a sheet having thickness of 4 mm, hot strip annealed, pickled, cold rolled and finish annealed. The slab was heated to 1200° C. and subjected to at least one rough hot rolling pass at a temperature between 970–1150° C. The friction between the hot mill rolls and the hot rolled steel was 0.3 or less, the rolling reduction ratio was between 40–75% and the hot rolling finishing temperature was 600–950° C. The hot rolled steel was annealed at a temperature of 850° C. for 4 hours, was cold reduced 82.5% and finish annealed at a temperature of 860° C. for 60 seconds.

It is known when the solubility product of titanium compounds exceeds the saturation level at the liquidus temperature, i.e., hyper-equilibrium, for titanium stabilized stainless steels, the titanium compounds are stable and TiN will precipitate before freezing of the metal. Steel sheet produced from these hyper-equilibrium slabs exhibit improved ridging characteristics and formability. Upon freezing, however, the TiN coalesced into large clusters and floated to the surface of the cast slab. These non-metallic TiN clusters formed unacceptable open surface defects known as a Ti-streaks during hot rolling. These large non-metallic clusters must be removed from the slab by costly surface conditioning such as grinding prior to hot processing of the slab. U.S. Pat. No. 4,964,926 relates to weldable dual stabilized ferritic stainless steel having improved surface quality by eliminating the formation and precipitation of non-metallic titanium oxides and titanium nitrides during casting by forming a sub-equilibrium titanium stabilized ferritic stainless steel. This patent discloses it was known that roping characteristics could be improved by adding niobium alone or niobium and copper to a ferritic stainless steel. However, the addition of niobium alone caused weld cracking. U.S. Pat. No. 4,964,926 discloses replacing a portion of a titanium stabilizer with a niobium stabilizer to form a dual stabilized ferritic stainless steel. An addition of at least 0.05% titanium to a niobium stabilized steel eliminates weld cracking.

Pending U.S. patent application Ser. No. 08/994,382, filed Dec. 19, 1997, entitled "Non-Ridging Ferritic Chromium Alloyed Steel", now U.S. Pat. No. 5,868,875 incorporated herein by reference, relates to a titanium deoxidized, ferritic chromium alloyed steel formed from a melt having an as-cast fine equiaxed grain structure. This application discloses a ferritic chromium alloyed steel formed from a melt deoxidized with titanium and containing no greater than 0.01 wt. % aluminum. A hot processed sheet produced from steel having this as-cast equiaxed grain structure is especially suitable for a cold reduced, recrystallization annealed sheet having excellent formability, stretching and non-ridging characteristics without an extra processing step, such as hot band anneal or an intermediate anneal.

The minimization of ridging by prior artisans has sacrificed cost and formability by annealing hot rolled ferritic stainless steel prior to cold reduction. This additional annealing step reduces formability by lowering the average $R_m$. Also, this pre-annealed hot rolled steel must be cold reduced at least 70% to obtain an $R_m$ after final annealing similar to the $R_m$ for a hot rolled steel that otherwise is not annealed before cold reduction. This greater percentage cold reduction generally requires an intermediate annealing step as well. As evidenced by the seemingly endless struggle of others, there remains a long felt need for an annealed ferritic chromium alloyed steel essentially free of ridging and having excellent deep formability characteristics such as a high $R_m$, a high tensile elongation and a uniformly annealed grain structure. There remains a further need for an excellent deep formability ferritic stainless steel having good ridging characteristics that does not require a hot processed sheet to be annealed prior to cold reduction. There remains a further need for an excellent deep formability sub-equilibrium, ferritic stainless steel having good ridging characteristics formed from a hot processed sheet that does not have surface defects, i.e., titanium nitride scale and titanium oxide streaks, without requiring surface conditioning of the surfaces of a continuously cast slab prior to hot processing of the slab.

BRIEF SUMMARY OF THE INVENTION

A principal object of this invention is to provide an excellent deep formability and stretchable ferritic chromium alloyed steel sheet with good ridging characteristics without requiring a hot processed sheet be annealed prior to cold reduction.

Another object of this invention is to provide a ferritic chromium alloyed steel sheet with good ridging characteristics and improved grain structure and high tensile elongation characteristics without requiring a hot processed sheet be annealed prior to cold reduction.

Another object of this invention is to provide an excellent deep formability and stretchable ferritic chromium alloyed steel sheet with good ridging characteristics without requiring multiple cold reductions with annealing between the cold reduction stages.

Another object of this invention is to form a ferritic chromium alloyed steel sheet from a continuously cast slab that does not require surface conditioning prior to hot processing the steel slab.

Another object of this invention is to provide an excellent deep formability and stretchable ferritic chromium alloyed steel sheet with good ridging characteristics formed from a continuously cast slab that does not require surface conditioning prior to hot processing the steel slab.

Additional objects include providing an excellent deep formability ferritic chromium alloyed steel sheet with good ridging characteristics having improved weldability, corrosion resistance and high temperature cyclical oxidation resistance.

The invention relates to a ferritic chromium alloyed steel and a process for producing the steel with an as-cast structure having greater than 50% equiaxed grains. The as-cast steel is deoxidized with titanium and contains up to 0.08% C, at least about 8% Cr, up to 1.50% Mn, $\leqq$0.05% N, $\leqq$1.5% Si, <2.0% Ni, Ti$\geqq$0.10%, wherein the ratio of (Ti×N)/Al is at least 0.14, all percentages by weight, the balance Fe and residual elements. The as-cast steel is hot processed into a continuous sheet. The sheet may be descaled, cold reduced to a final thickness and then recrystallization annealed. Annealing the hot processed sheet prior to cold reduction or annealing the sheet between multiple cold reduction stages to eliminate ridging in the final annealed sheet is not necessary.

Another feature of this invention is for the aforesaid Ti being $\geqq$0.15% and the aluminum being <0.02%.

Another feature of this invention is for the aforesaid ratio of (Ti×N)/Al being at least 0.20.

Another feature of this invention is for the aforesaid Ti satisfying the relationship $(Ti/48)/[(C/12)+(N/14)]>1.5$.

Another feature of this invention is for the aforesaid Ti and N being present in sub-equilibrium amounts.

Another feature of this invention is for the aforesaid cold reduced, annealed sheet to have an $R_m$ of $\geqq$1.4 by being produced from a hot processed sheet that was not annealed prior to cold reduction.

Another feature of this invention is for the aforesaid as-cast equiaxed grains having a size $\leqq$3 mm.

Advantages of this invention include a highly formable ferritic chromium alloyed steel with excellent ridging characteristics that is less costly to manufacture, does not require a hot processed sheet to be annealed prior to cold reduction, does not require annealing a sheet between multiple cold reduction stages, has improved surface quality, has improved weldability, good wet corrosion resistance and has good high temperature cyclical oxidation resistance. Another advantage is being able to cast a slab that does not require surface conditioning, e.g., grinding, prior to hot processing to prevent formation of open surface defects extending parallel to the rolling direction in a hot processed sheet such hot rolling scale and streaks rolled from non-metallic titanium oxide or titanium nitride cluster type precipitates formed near a slab surface during casting.

Another advantage of this invention includes a highly formable ferritic chromium alloyed steel sheet with excellent ridging characteristics having very uniform grain structure in the sheet after annealing.

The above and other objects, features and advantages of this invention will become apparent upon consideration of the detailed description and appended drawings.

DETAILED DESCRIPTION OF THE PREFERRED EMBODIMENT

Figure 1:
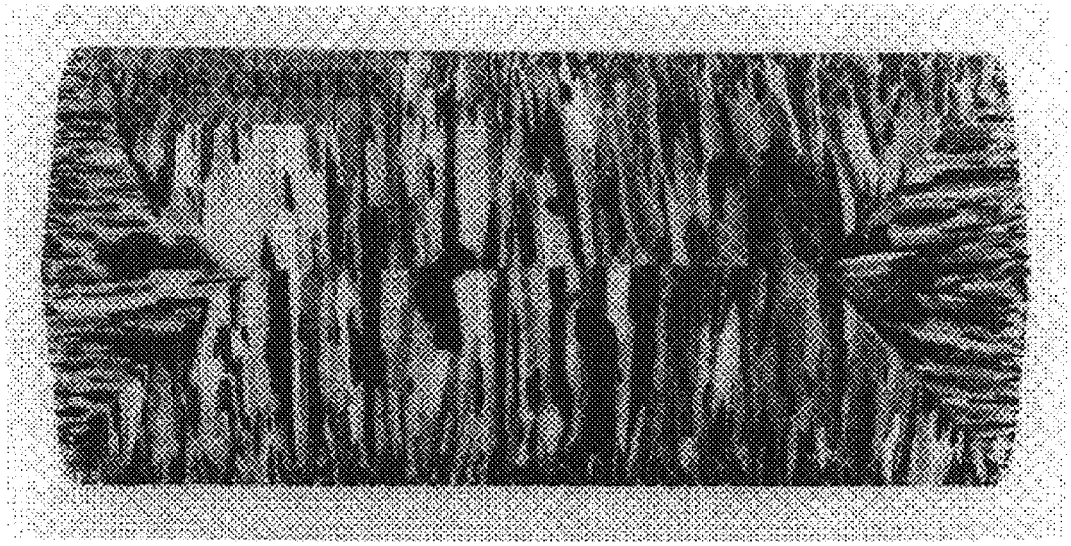
FIG. 1 is a photograph of an as-cast grain structure containing 100% large columnar grains for a ferritic chromium alloyed steel having a ratio of the product of titanium and nitrogen divided by aluminum of 0.13.

This invention relates to a highly formable ferritic chromium alloyed steel sheet produced from a steel having an as-cast structure of fine equiaxed grains. The steel is cast from a melt containing sufficient titanium and nitrogen but a controlled amount of aluminum for forming small titanium oxide inclusions to provide the necessary nuclei for forming the as-cast equiaxed grain structure so that an annealed chromium alloyed sheet produced from this steel has enhanced ridging characteristics. By forming a chromium alloyed ferrous melt rich in small titanium oxide inclusions rather than large alumina inclusion clusters, an as-cast grain structure having greater than 50% equiaxed fine grains (% EQ) can be formed. By avoiding the formation of large columnar grains in the as-cast steel, ridging is minimized in a cold rolled, recrystallization annealed sheet produced from the steel, even when a hot processed sheet formed from the steel is not annealed prior to cold reduction.

By ferritic chromium alloyed steel is meant to include a steel alloyed with at least about 8% chromium. The ferritic chromium alloyed steels of this invention are especially suited for hot processed sheets, cold reduced sheets, metallic coated sheets and painted sheets. These ferritic chromium alloyed steels are well suited for stainless steels of the AISI Type 400 series containing about 10–25% Cr, especially 409 Type stainless steel containing about 11–13% Cr. For this invention, it also will be understood that by "sheet" is meant to include continuous strip or cut lengths formed from continuous strip.

A ferrous melt is provided in a melting furnace such as an electric arc furnace (EAF). This ferrous melt may be formed in the melting furnace from solid iron bearing scrap, carbon steel scrap, stainless steel scrap, solid iron containing materials including iron oxides, iron carbide, direct reduced iron, hot briquetted iron, or the melt may be produced upstream of the melting furnace in a blast furnace or any other iron smelting unit capable of providing a ferrous melt. The ferrous melt then will be refined in the melting furnace or transferred to a refining vessel such as an argon-oxygen-decarburization vessel (AOD) or a vacuum-oxygen-decarburization vessel (VOD), followed by a trim station such as a ladle metallurgy furnace (LMF) or a wire feed station.

An important feature of this invention is after refining the melt to a final carbon analysis and during or after trim alloys to meet a final specification are added to the melt, titanium is added to the melt for deoxidation prior to casting. Deoxidation of the melt with titanium is necessary for forming small titanium oxide inclusions for forming the nuclei necessary for forming an as-cast equiaxed fine grain structure. To provide sufficient numbers of these nuclei necessary for forming the as-cast equiaxed fine grain structure, at least about 0.10% Ti is necessary in the melt. Aluminum preferably is not added to this refined melt as a deoxidant to minimize formation of alumina inclusions, i.e., aluminum oxide, $Al_2O_3$. An equally important feature of this invention is that sufficient titanium and nitrogen be present in the melt prior to casting so that the ratio of the product of titanium and nitrogen divided by residual aluminum (TNA) be at least about 0.14. By controlling this ratio to at least 0.14, it is believed nitrogen in the melt forms small titanium oxide inclusions coated with titanium nitride insuring the small nucleation sites necessary for forming the as-cast fine equiaxed grains. If the steel is to be stabilized, sufficient amount of the titanium beyond that required for deoxidation, i.e., 0.10%, can be added for combining with carbon and nitrogen in the melt but preferably less than that required for saturation with nitrogen, i.e., sub-equilibrium, thereby avoiding precipitation of large titanium nitride inclusions before solidification. Alternatively, one or more stabilizing elements such as niobium, zirconium, tantalum and vanadium can be added to the melt as well. Accordingly, the steel of this invention has at least 0.10% Ti, preferably at least 0.005% N and preferably less than 0.02% Al in the melt so that the steel is essentially deoxidized by the titanium with small titanium oxide inclusions being the dominant inclusions in the melt, i.e., titanium oxide inclusions $>>Al_2O_3$ inclusions, to provide the nuclei necessary for forming an as-cast equiaxed grain structure.

Ferritic chromium alloyed steels deoxidized with aluminum rather than titanium can have small inclusions in a melt. However, a major difference between prior art aluminum deoxidized ferritic chromium steels compared to the titanium deoxidized ferritic chromium steels of this invention is that most of the inclusions of the inventive steel melts are titanium oxide based rather than alumina based. We have determined at least 50% of the inclusions of the steels of this invention have a particle size no greater than about 1 $\mu$m and at least 90% of these inclusions have a size no greater than about 1.5 $\mu$m. It is unclear as to which form(s) of titanium oxide, i.e., TiO, $TiO_2$, $Ti_2O_3$, $Ti_3O_5$, are present but it believed the primary inclusions present are TiO.

After being refined and alloyed with chromium in a melting or refining vessel, the chromium alloyed ferrous steel melt will be deoxidized with titanium and contain up to 0.08% C, at least about 8% Cr, up to 1.50% Mn, <0.03% Al, ≦0.05% N, ≦1.5% Si, <2.0% Ni, Ti≧0.10%, all percentages by weight, the balance Fe and residual elements. The ratio of the product of the weight percentages of titanium and nitrogen divided by residual aluminum must be at least about 0.14. The chromium alloyed steel melt may be continuously cast into a sheet, a thin slab ≦140 mm, a thick slab ≦200 mm or cast into an ingot having an as-cast grain structure formed of greater than 50% fine equiaxed grains. Preferably, the steel melt has a ratio of the product of the weight percentages of titanium and nitrogen divided by residual aluminum of at least 0.16, more preferably at least 0.23 and cast forming an as-cast structure at least 80% fine equiaxed grains and essentially all fine equiaxed grains respectively.

We have determined the ratio of the product of titanium and nitrogen divided by residual aluminum necessary to obtain an as-cast equiaxed grain also is related to the chromium content of the steel. For a T409 stainless steel containing about 11% chromium, the ratio of the product of titanium and nitrogen divided by residual aluminum to achieve greater than 50% as-cast equiaxed grains is at least about 0.14 and to achieve nearly 100% as-cast equiaxed grains is greater than 0.23. For a T430 stainless steel containing high chromium of at least about 16% and T439 stainless steel containing high chromium of at least about 17%, Tables 3 and 4 demonstrate the ratio of the product of titanium and nitrogen divided by residual aluminum to achieve greater than 50% as-cast equiaxed grains was greater than about 0.20 and to achieve nearly 100% as-cast equiaxed grains was greater than about 0.30.

The cast steel is hot processed into a sheet. By "hot processed" will be understood the as-cast steel will be reheated, if necessary, and then reduced to a predetermined thickness such as by hot rolling. If hot rolled, a steel slab is reheated to 1050–1300° C., hot rolled using a finishing temperature of at least 800° C. and coiled at a temperature ≦580° C. The hot rolled sheet, e.g., "hot band", may be descaled and cold reduced at least 40%, preferably at least 50%, to a desired final sheet thickness. Thereafter, the cold reduced sheet will be recrystallization annealed for at least 1 second at a peak metal temperature of 800–1000° C. A significant advantage of this invention is the hot processed sheet is not required to be annealed prior to this cold reduction. Another advantage of this invention is the hot processed sheet can be cold reduced in one stage thereby not requiring an intermediate anneal between multiple cold reductions. The recrystallization annealing following cold reduction may be a continuous anneal or a box anneal. Another advantage of this invention is that a chromium alloyed annealed steel sheet with excellent ridging characteristics has a very uniform fine grain structure with as little as 40% cold reduction.

The ferritic chromium alloyed steel of the present invention can be produced from a hot processed sheet made by a number of methods. The sheet can be produced from slabs formed from ingots or continuous cast slabs of 50–200 mm thickness which are reheated to 1050–1300° C. followed by hot rolling to provide a starting hot processed sheet of 1–6 mm thickness or the sheet can be hot processed from strip continuously cast into thicknesses of 2–10 mm. The present invention also is applicable to sheet produced by methods wherein continuous cast slabs or slabs produced from ingots are fed directly to a hot rolling mill with or without significant reheating, or ingots hot reduced into slabs of sufficient temperature to be hot rolled in to sheet with or without further reheating.

Figure 4:
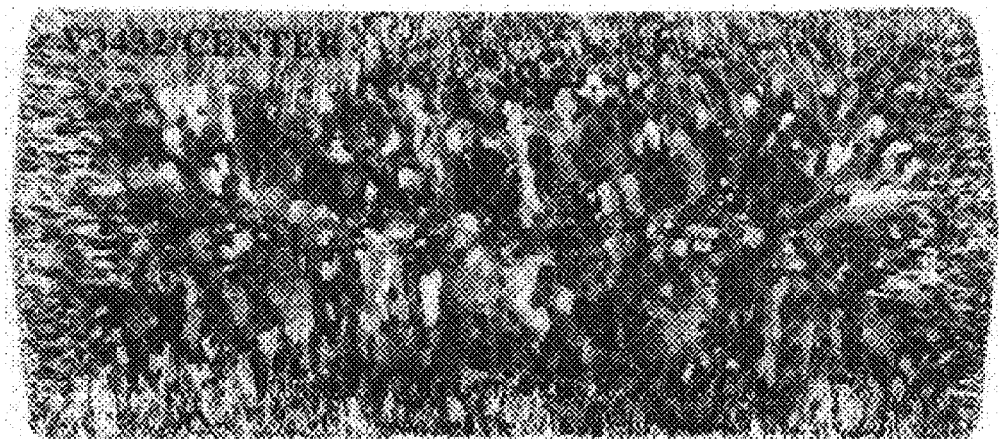
FIG. 4 is a photograph of an as-cast structure containing about 84% fine equiaxed grains for a ferritic chromium alloyed steel having a ratio of the product of titanium and nitrogen divided by aluminum of 0.15.

An important feature of this invention is that titanium is used for deoxidation of the melt prior to casting. Titanium is used for deoxidation to insure the dominant inclusions in the melt are small titanium oxide inclusions for nucleating the as-cast equiaxed ferrite grains. The amount of titanium in the melt will be at least 0.10% and preferably is a sub-equilibrium amount. More preferably, the amount of titanium in this steel melt will be ≧0.15% and satisfy the relationship $(Ti/48)/[(C/12)+(N/14)]>1.5$. By "sub-equilibrium" is meant the amount of titanium is controlled so that the solubility product of the titanium compounds formed are below the saturation level at the steel liquidus temperature thereby avoiding excessive TiN precipitation in the melt. If excessive TiN inclusions are allowed to form, the TiN precipitates grow into low density, large clusters which float to solidifying slab surfaces during continuous casting. These non-metallic TiN clusters form open surface defects during hot processing of the slab. The amount of titanium permitted in the melt to avoid excessive precipitation is inversely related to the amount of nitrogen. The maximum amount of titanium for "sub-equilibrium" is generally illustrated in FIG. 4 of U.S. Pat. No. 4,964,926, incorporated herein by reference. Depending upon the chromium and nitrogen content of a molten steel alloy, the amount of titanium must be controlled to less than that indicated by the curves in FIG. 4 of U.S. Pat. No. 4,964,926. T409 stainless steel containing about 12% Cr and 0.010% N can contain up to about 0.26% Ti. Stainless steel containing about 15% Cr and 0.010% N can contain up to about 0.30% Ti. T439 stainless steel containing about 18% Cr and 0.010% N can contain up to about 0.35% Ti. Excessive nitrogen is not a problem for those manufacturers that refine ferritic stainless steel melts in an AOD. Nitrogen substantially below 0.010% can be obtained when refining the stainless steel in an AOD thereby allowing increased amount of titanium to be tolerated and still be at sub-equilibrium.

To provide the nucleation sites necessary for forming as-cast equiaxed ferrite grains, sufficient time after making the titanium addition to the melt must have elapsed to allow the titanium oxide inclusions to form before casting the melt. If the melt is cast immediately after adding titanium, the as-cast structure of the casting will be large columnar grains. Ingots cast in the laboratory less than 5 minutes after adding the titanium to the melt had large as-cast columnar grains even when the product of titanium and nitrogen divided by residual aluminum was at least 0.14.

An important feature of this invention is that sufficient nitrogen be present in the steel prior to casting so that the ratio of the product of titanium and nitrogen divided by aluminum be at least about 0.14. By controlling this ratio, it is believed sufficient titanium oxide inclusions are formed insuring the necessary nucleation sites for forming the as-cast equiaxed grains. The amount of nitrogen present in the melt should be ≦0.05%, preferably 0.005–0.03% and more preferably 0.007–0.015%. It is believed small titanium oxide inclusions coated with titanium nitride are responsible for providing the nucleation sites necessary for the formation of an as-cast fine equiaxed grain structure. By carefully controlling the amounts of titanium and nitrogen in the melt, it is believed sufficient small titanium oxide inclusions having a size less than 1 $\mu$m form providing the necessary nucleation sites responsible for the fine as-cast equiaxed grain structure.

A steel alloy composition can be controlled with respect to N and the sub-equilibrium amount of Ti to obviate excessive TiN precipitation and Ti-streak formation in the hot processed sheet. Although N concentrations after melting in an EAF may be as high as 0.05%, the amount of dissolved N can be reduced during argon gas refining in an AOD to less than 0.02% and, if necessary, to less than 0.01%. Precipitation of excessive TiN can be avoided by reducing the sub-equilibrium amount of Ti to be added to the melt for any given nitrogen content. Alternatively, the amount of nitrogen in the melt can be reduced in an AOD for an anticipated amount of Ti contained in the melt. For a sub-equilibrium T409 stainless steel containing about 11–13% Cr and no more than about than 0.012% N, the steel melt would contain less than about 0.25% Ti, to avoid excessive TiN precipitation before solidification of the melt. For a sub-equilibrium T430 or T439 stainless steel containing about 16–18% Cr and no more than about 0.012% N, the steel melt would contain less than about 0.35% Ti to avoid excessive TiN precipitation before solidification of the melt.

An equally important feature of this invention is for total residual aluminum being controlled or minimized relative to the amounts of titanium and nitrogen. Minimum amounts of titanium and nitrogen must be present in the melt relative to the aluminum. We have determined even low amounts of aluminum, i.e., no greater than 0.01%, will not produce the prerequisite equiaxed as-cast grains if the amounts of titanium and especially nitrogen are too low. A threshold amount of small precipitates of titania inclusions, even in the absence of alumina inclusions, apparently are required in the melt to form the necessary nucleation sites for forming the as-cast equiaxed grain structure. We have determined the ratio of the product of titanium and nitrogen divided by residual aluminum must be at least about 0.14, preferably at least 0.23 to insure nearly 100% equiaxed as-cast grains. To minimize the amounts of titanium and nitrogen required in the melt, the amount of aluminum preferably is <0.020%, more preferably ≦0.013% and most preferably reduced to ≦0.010%. If aluminum is not purposefully alloyed with the melt during refining or casting such as for deoxidation immediately prior to casting, total aluminum can be controlled or reduced to less than 0.010%, especially for stainless steels containing less than 14% Cr. For a stainless steel containing high chromium, i.e., Cr≧15%, requiring the ratio of (Ti×N)/Al>0.40 to achieve nearly 100% as-cast fine equiaxed grains, it may be necessary to add nitrogen to the melt to greater than 0.01%. Aluminum preferably is not to be inadvertently added to the melt as an impurity present in an alloy addition of another element, e.g., titanium. The use of titanium alloy additions containing an impurity of aluminum preferably should be avoided. Titanium alloys may contain as much as 20% Al which may contribute as much as 0.07% total Al to the melt. By carefully controlling the refining and casting practices, a melt containing <0.020% aluminum can be obtained.

Not being bound by theory, it is believed total aluminum, especially for stainless steels containing less than 14% Cr, must be controlled to less than 0.03%, preferably to less than 0.02%, more preferably to no more than 0.013%, most preferably to less than 0.01%, to minimize the formation of $Al_2O_3$ inclusions in the melt so that titanium is the primary deoxidant. Steel continuously cast into a thin slab or a continuous sheet does not inherently have an as-cast fine equiaxed grain structure. It is believed by carefully controlling the aluminum in this invention, the formation of $Al_2O_3$ inclusions can be minimized. $Al_2O_3$ inclusions contained in a melt tend to coalesce into large clusters. By minimizing the formation of alumina inclusions, it is further believed small inclusions having a size less than 5 $\mu$m, preferably no greater than 1.5 $\mu$m and more preferably no greater than 1 $\mu$m of titanium oxide become the dominant non-metallic inclusions in the melt. These small titanium oxide inclusions are believed to provide nucleation sites permitting the formation of an as-cast fine equiaxed grain structure during solidification. Accordingly, titanium is used for deoxidation to insure the dominant inclusions in the melt and solidified cast steel are small titanium oxides rather than alumina inclusions, i.e., number of titanium oxide inclusions>>alumina inclusions.

Aluminum deoxidized steels of the prior art tended to clog nozzles during continuous casting. Calcium generally was required to be added to the high aluminum steel to increase the fluidity of $Al_2O_3$ inclusions in the cast melt to minimize this tendency to plug the casting nozzle. However, calcium generally adversely affects the formation of an as-cast fine equiaxed grain. Accordingly, calcium should be limited to ≦0.0020%. An important advantage of this invention is to obviate the need for the addition of calcium to the low aluminum melt since very few $Al_2O_3$ inclusions are present in the melt when aluminum is maintained at ≦0.016%. Large numbers of $Al_2O_3$ inclusions contained in a melt can quickly coalesce into clusters of alumina which can cause nozzle clogging during continuous casting.

Carbon is present in the steels of the present invention in an amount of up to 0.08%, preferably ≦0.02% and more preferably 0.0010–0.01%. If carbon exceeds about 0.08%, the formability, corrosion and weldability are deteriorated. Accordingly, carbon should be reduced to an amount as low as possible.

An element for stabilizing carbon and nitrogen may be present in the steels of the present invention in an amount up to 1.0%, preferably up to 0.6% and more preferably up to 0.3%. If a stabilized steel is desired, sufficient stabilizing element should be present to form a stable carbo-nitride compound effective for making a crystalline grain size for increasing the elongation and toughness of the stainless steel thereby enhancing formability such as deep drawability after annealing. If the stabilizing element is greater than about 1.0%, the cost of producing the steel is increased without any corresponding benefit in properties. In addition to using titanium for stabilization, other suitable stabilizing elements may also include niobium, zirconium, tantalum, vanadium or mixtures thereof with titanium alone being preferred. If a second stabilizing element along with titanium is used, e.g., niobium, the second stabilizing element should be limited to no more than about 0.3% when deep formability is required. Nb above 0.3% adversely affects formability.

Chromium is present in the steels of the present invention in an amount of ≧8%, preferably ≧10%. If chromium is less than about 8%, the wet corrosion resistance, e.g., automotive exhaust components, of the steel is adversely affected. If chromium is greater than about 25%, the formability of the steel is deteriorated.

For some applications, it may be desirable to add boron to the steels of the present invention in an amount of ≧5 ppm, more preferably ≧20 ppm, most preferably 40–60 ppm. By having boron of at least 5 ppm, the resistance to secondary work embrittlement of steel is improved so that the steel sheet will not split during deep drawing applications and multi-step forming applications. If boron is greater than about 200 ppm, the formability of the steel is deteriorated.

Oxygen is present in the steels of the present invention preferably in an amount <100 ppm. When a steel melt is prepared sequentially in an AOD refining vessel and a LMF alloying vessel, oxygen in the melt will be within the range of 10–60 ppm thereby providing a very clean steel having small titanium oxide inclusions that are necessary for forming the nucleation sites responsible for the fine as-cast equiaxed grain structure.

Silicon is generally present in the chromium alloyed steels of the present invention in an amount ≦1.5%, preferably ≦0.5%. A small amount of silicon generally is present in a ferritic stainless steel to promote formation of the ferrite phase. Silicon also enhances high temperature corrosion resistance and provides high temperature strength, e.g., automotive exhaust components. Accordingly, silicon should be present in the melt in an amount of at least 0.10%. Silicon should not exceed about 1.5% because the steel is too hard and the elongation is adversely affected.

Manganese is present in the steels of the present invention in an amount up to 1.5%, preferably less than 0.5%. Manganese improves hot workability by combining with sulfur as manganese sulfide to prevent tearing of the sheet during hot processing. Accordingly, manganese in amounts of at least 0.1% is desirable. However, manganese is an austenite former and affects the stabilization of the ferrite phase. If the amount of manganese exceeds about 1.5%, the stabilization and formability of the steel is adversely affected.

Sulfur is present in the steels of the present invention preferably in an amount of ≦0.015%, more preferably <0.010% and most preferably <0.005%. In addition to causing a problem during hot rolling, sulfur adversely affects wet corrosion resistance, especially those steels containing a lower amount of chromium. Accordingly, the sulfur preferably should not exceed about 0.015%.

Like manganese, nickel is an austenite former and affects the stabilization of the ferrite phase. Accordingly, nickel is limited to ≦2.0%, preferably <1.0%.

The ferritic chromium alloyed steel of this invention may also include other elements such as copper, molybdenum, phosphorus and the like made either as deliberate additions or present as residual elements, i.e., impurities from steelmaking process.

EXAMPLE 1

A comparative chromium alloyed ferrous melt of about 25 kg was provided in a laboratory vacuum vessel. After final trim alloying elements were added to the vessel, the melt was deoxidized with titanium. The composition of the chromium alloyed steel melt was 0.006% Al, 0.15% Ti, 0.007% C, 0.26% Mn, 0.36% Si, 11.2% Cr, 0.18% Ni and 0.005% N. The ratio of the product of titanium and nitrogen divided by aluminum was 0.125. About 23 minutes after making the titanium addition, the melt was cast into an ingot having a thickness and width of about 75 mm and about 150 mm respectively. An as-cast grain structure of a cross-section piece shown in FIG. 1 cut from the stainless steel ingot had a grain structure that was completely columnar and having an average column size of about 3 mm. This steel demonstrates that having low aluminum alone, i.e., ≦0.01%, is not sufficient to form an as-cast structure of predominantly equiaxed grains. This steel having a ratio of (Ti×N)/Al<0.14 illustrates an as-cast steel grain structure containing no equiaxed grains.

EXAMPLE 2

Figure 2:
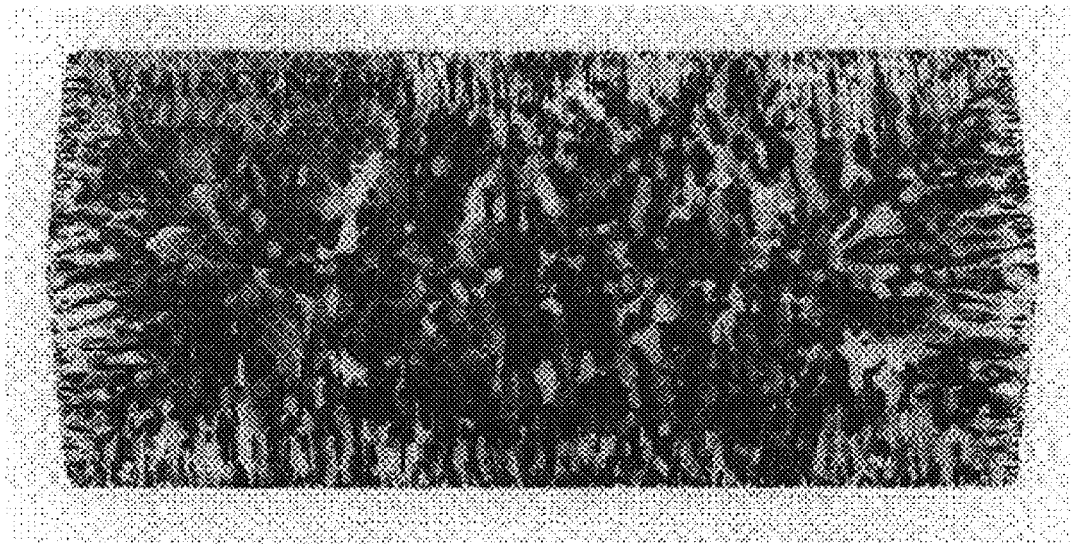
FIG. 2 is a photograph of an as-cast structure containing about 78% fine equiaxed grains for a ferritic chromium alloyed steel having a ratio of the product of titanium and nitrogen divided by aluminum of 0.16.

A chromium alloyed ferrous melt of the invention of about 25 kg was provided in the same laboratory vacuum vessel as described in Example 1. After final trim alloying elements were added to the vessel, the melt was deoxidized with titanium. The composition of the chromium alloyed steel melt was 0.007% Al, 0.28% Ti, 0.008% C, 0.25% Mn, 0.36% Si, 11.1% Cr, 0.18% Ni and 0.004% N. The ratio of the product of titanium and nitrogen divided by aluminum was increased to 0.16. About 17 minutes after making the titanium addition, the melt was cast into an ingot having a thickness and width of about 75 mm and about 150 mm respectively. An as-cast grain structure of a cross-section piece cut from the stainless steel ingot had a fine grain structure of about 78% equiaxed grains and an average diameter size of about 2 mm as shown in FIG. 2. This steel having a ratio (Ti×N)/Al≧0.14 illustrates that an as-cast steel grain structure will contain ≧50% fine equiaxed grains.

EXAMPLE 3

Figure 3:
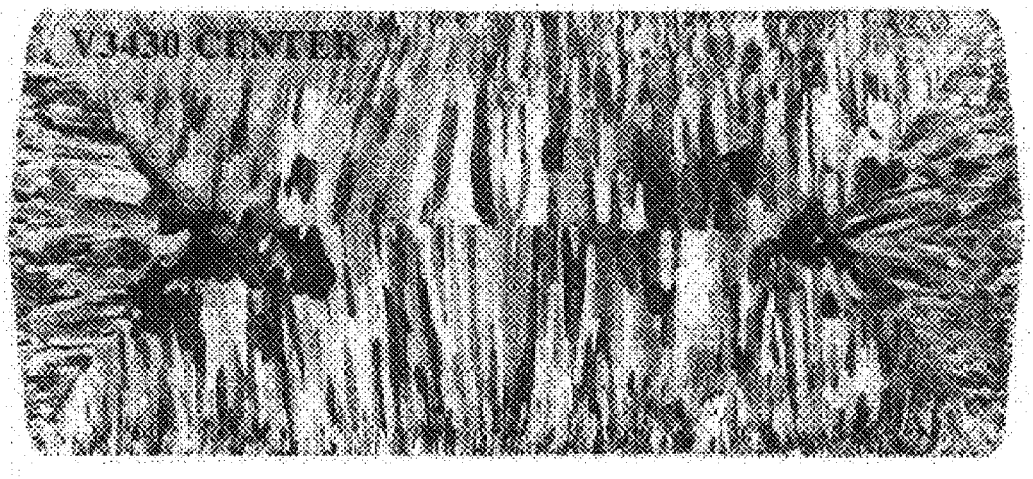
FIG. 3 is a photograph of an as-cast structure containing 100% large columnar grains for a ferritic chromium alloyed steel having a ratio of the product of titanium and nitrogen divided by aluminum of 0.13.

Another comparative chromium alloyed ferrous melt of the invention was produced in a manner similar to that in Example 1 had a composition of 0.013% Al, 0.19% Ti, 0.007% C, 0.26% Mn, 0.36% Si, 11.0% Cr, 0.24% Ni and 0.009% N. The ratio of the product of titanium and nitrogen divided by aluminum was 0.13. About 19 minutes after making the titanium addition, this steel melt was cast into an ingot. An as-cast grain structure of cross-section piece cut from the stainless steel ingot had a grain structure that was completely columnar and had an average column size of about 2 mm as shown in FIG. 3. This steel having a ratio of (Ti×N)/Al<0.14 illustrates that an as-cast steel grain structure will contain <50% equiaxed grains.

EXAMPLE 4

Another chromium alloyed ferrous melt of the invention was produced in a manner similar to that in Example 2 had a composition of 0.013% Al, 0.24% Ti, 0.007% C, 0.26% Mn, 0.37% Si, 11.1% Cr, 0.25% Ni and 0.008% N. The ratio of the product of titanium and nitrogen divided by aluminum was increased to 0.15. This steel melt was cast into an ingot within about 14 minutes after making the titanium addition. An as-cast structure of the cross-section piece cut from the stainless steel ingot had a fine grain structure of about 84% equiaxed grains and an average diameter size of about 3 mm as shown in FIG. 4. This steel illustrates that an as-cast steel grain structure will contain ≧50% fine equiaxed grains even though the steel has high aluminum, i.e., ≧0.01%, if the ratio (Ti×N)/Al≧0.14.

Figure 13:
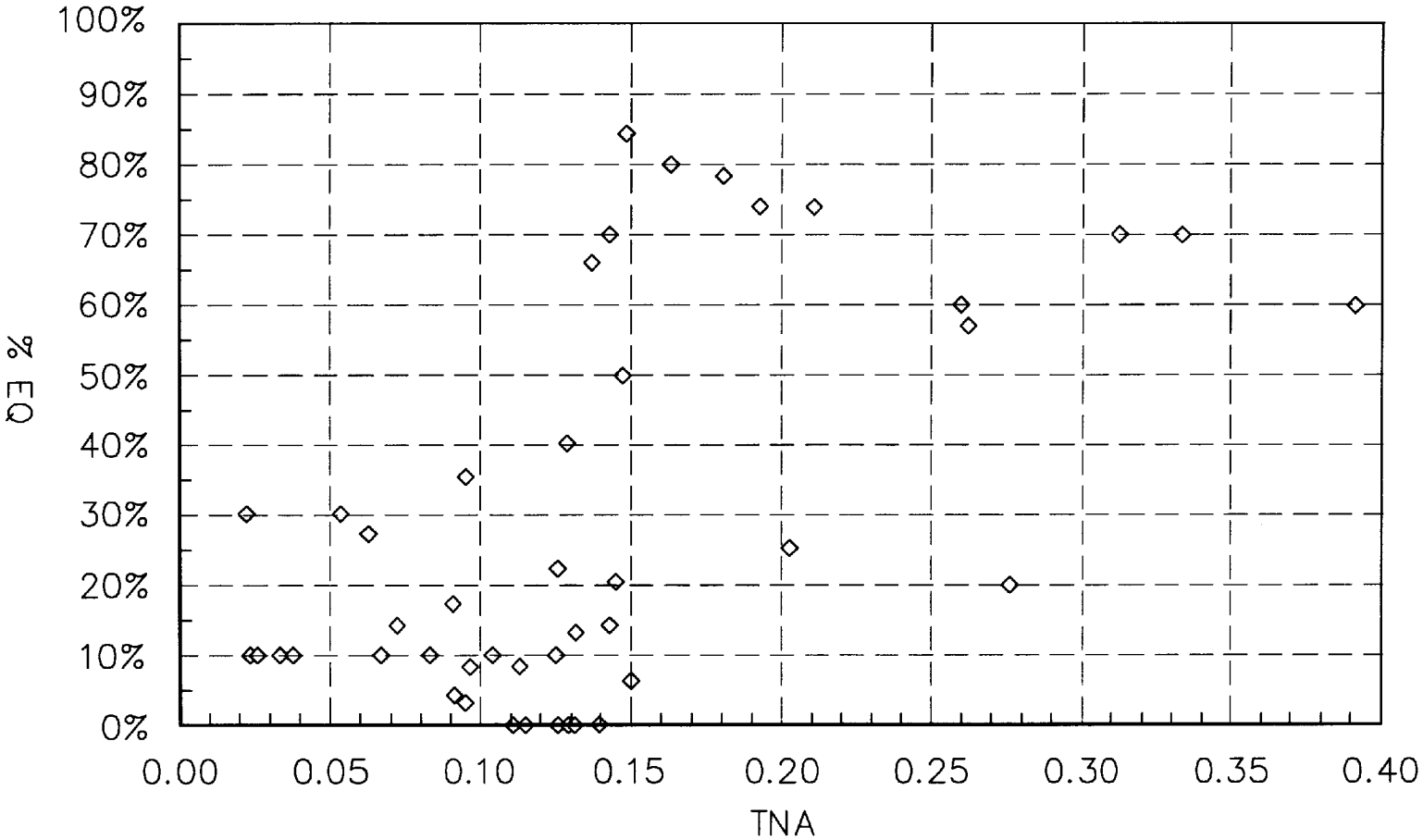
FIG. 13 is a graph illustrating the % equiaxed grains (% EQ) in the as-cast grain structure as a function of the ratio of the product of the weight percentages of titanium and nitrogen divided by aluminum (TNA) for laboratory ingots cast from ferritic chromium alloyed steel.

The compositions, TNA and % EQ of the as-cast ingots for the comparative and inventive Type 409 stainless melts of Examples 1–4 above as well as many additional comparative and inventive Type 409 stainless laboratory melts produced and cast into ingots in a manner similar to that described for Examples 1–4 are summarized in Table 1. The % EQ as a function of TNA for these ingots is shown in FIG. 13. FIG. 13 generally demonstrates that Ti of at least about 0.10% and a TNA, i.e., (Ti×N)/Al, of about 0.14 or more are necessary to obtain an as-cast steel grain structure containing at least 50% fine equiaxed grains.

TABLE 1

| HT# | C | N | S | Cr | Ti | Cb | Si | Al | Mo | Ni | Mn | Cu | P | V | Ca | TNA | % EQ |
|---|---|---|---|---|---|---|---|---|---|---|---|---|---|---|---|---|---|
| V3277 | .0072 | .0065 | .0010 | 11.12 | .18 | <.01 | .51 | .054 | .050 | .19 | .25 | .082 | .022 | .030 | .0013 | .022 | 30% |
| V3312 | .0058 | .0066 | .0010 | 11.12 | .19 | <.01 | .53 | .055 | .051 | .20 | .25 | .088 | .022 | .030 | .0002 | .023 | 10% |
| V3310 | .0059 | .0060 | .0011 | 11.09 | .22 | <.01 | .53 | .053 | .051 | .15 | .21 | .087 | .020 | .031 | .0014 | .025 | 10% |
| V3309 | .0079 | .0092 | .0010 | 11.00 | .19 | <.01 | .54 | .053 | .051 | .22 | .31 | .093 | .021 | .032 | .0015 | .033 | 10% |
| V3304 | .0057 | .0095 | .0011 | 11.14 | .19 | <.01 | .52 | .049 | .050 | .25 | .30 | .087 | .021 | .031 | — | .037 | 10% |
| V3303 | .0060 | .0088 | .0013 | 11.12 | .20 | <.01 | .52 | .047 | .051 | .19 | .26 | .089 | .023 | .029 | .0014 | .037 | 10% |
| V3276 | .0073 | .0070 | .0010 | 11.10 | .19 | <.01 | .51 | .025 | .050 | .18 | .25 | .081 | .021 | .030 | .0011 | .053 | 30% |
| V3446 | .0111 | .0133 | .0021 | 11.14 | .28 | <.01 | .36 | .060 | .057 | .24 | .26 | .082 | .025 | .031 | <.0002 | .062 | 27% |
| V3308 | .0060 | .0073 | .0009 | 11.10 | .19 | <.01 | .52 | .021 | .051 | .19 | .25 | .087 | .021 | .031 | .0015 | .066 | 10% |
| V3437 | .0069 | .0075 | .0021 | 11.14 | .22 | <.01 | .37 | .023 | .064 | .27 | .26 | .083 | .022 | .030 | <.0002 | .072 | 14% |
| V3305 | .0050 | .0074 | .0010 | 11.11 | .19 | <.01 | .53 | .017 | .051 | .20 | .26 | .090 | .023 | .032 | — | .083 | 10% |
| V3439 | .0064 | .0115 | .0020 | 11.16 | .22 | <.01 | .36 | .028 | .061 | .25 | .25 | .081 | .024 | .029 | <.0002 | .090 | 17% |
| V3412 | .0091 | .0048 | .0023 | 11.13 | .14 | <.01 | .36 | .007 | .052 | .18 | .26 | .081 | .026 | .029 | <.0002 | .091 | 4% |
| V3413 | .0068 | .0043 | .0019 | 11.09 | .18 | <.01 | .35 | .008 | .050 | .16 | .25 | .082 | .027 | .031 | <.0002 | .094 | 3% |
| V3445 | .0119 | .0123 | .0021 | 11.12 | .30 | <.01 | .35 | .039 | .050 | .20 | .25 | .082 | .024 | .032 | <.0002 | .095 | 35% |
| V3436 | .0066 | .0061 | .0020 | 11.11 | .22 | <.01 | .37 | .014 | .051 | .23 | .26 | .082 | .023 | .030 | <.0002 | .096 | 8% |
| V3442 | .0067 | .0090 | .0018 | 11.15 | .31 | <.01 | .37 | .027 | .050 | .23 | .26 | .084 | .025 | .030 | <.0002 | .103 | 10% |
| V3433 | .0084 | .0110 | .0016 | 11.15 | .19 | <.01 | .37 | .019 | .052 | .26 | .27 | .083 | .026 | .031 | <.0002 | .110 | 0% |
| V3429 | .0071 | .0071 | .0015 | 11.12 | .19 | <.01 | .36 | .012 | .051 | .20 | .26 | .082 | .027 | .029 | <.0002 | .112 | 8% |
| V3275 | .0078 | .0070 | .0011 | 11.11 | .18 | <.01 | .52 | .011 | .050 | .20 | .25 | .081 | .021 | .031 | — | .115 | 0% |
| V3306 | .0062 | .0073 | .0013 | 11.10 | .17 | <.01 | .52 | .010 | .051 | .20 | .25 | .086 | .020 | .032 | .0001 | .124 | 10% |
| V3434 | .0066 | .0118 | .0017 | 11.13 | .19 | <.01 | .37 | .018 | .050 | .22 | .26 | .083 | .024 | .031 | <.0002 | .125 | 22% |
| V3405 | .0067 | .0050 | .0024 | 11.15 | .15 | <.01 | .36 | .006 | .058 | .18 | .26 | .083 | .028 | .027 | <.0002 | .125 | 0% |
| V3311 | .0064 | .0071 | .0010 | 11.11 | .18 | <.01 | .53 | .010 | .051 | .20 | .26 | .087 | .022 | .032 | .0008 | .128 | 40% |
| V3410 | .0064 | .0054 | .0018 | 11.15 | .19 | <.01 | .36 | .008 | .052 | .21 | .26 | .083 | .027 | .030 | <.0002 | .128 | 0% |
| V3430 | .0066 | .0089 | .0017 | 11.04 | .19 | <.01 | .36 | .013 | .058 | .24 | .26 | .081 | .025 | .028 | <.0002 | .130 | 0% |
| V3438 | .0068 | .0100 | .0019 | 11.15 | .30 | <.01 | .36 | .023 | .058 | .24 | .25 | .082 | .022 | .031 | <.0002 | .130 | 13% |
| V3409 | .0063 | .0042 | .0023 | 11.17 | .26 | <.01 | .36 | .008 | .051 | .20 | .26 | .083 | .028 | .031 | <.0002 | .137 | 66% |
| V3435 | .0067 | .0100 | .0022 | 11.10 | .25 | <.01 | .37 | .018 | .051 | .21 | .25 | .082 | .023 | .031 | <.0002 | .139 | 0% |
| V3441 | .0070 | .0168 | .0020 | 11.15 | .22 | <.01 | .37 | .026 | .055 | .24 | .26 | .082 | .025 | .031 | <.0002 | .142 | 14% |
| V3274 | .0071 | .0067 | .0013 | 11.06 | .17 | <.01 | .52 | .008 | .050 | .20 | .26 | .083 | .021 | .031 | — | .142 | 70% |
| V3307 | .0063 | .0076 | .0010 | 11.13 | .19 | <.01 | .52 | .010 | .051 | .19 | .26 | .088 | .023 | .033 | .0014 | .144 | 20% |
| V3407 | .0069 | .0049 | .0025 | 11.12 | .23 | <.01 | .36 | .008 | .052 | .15 | .25 | .082 | .029 | .030 | <.0002 | .146 | 50% |
| V3432 | .0072 | .0080 | .0017 | 11.11 | .24 | <.01 | .37 | .013 | .051 | .25 | .26 | .084 | .026 | .029 | <.0002 | .148 | 84% |
| V3406 | .0075 | .0055 | .0028 | 11.11 | .19 | <.01 | .35 | .007 | .062 | .22 | .26 | .082 | .028 | .030 | <.0002 | .149 | 6% |
| V3295 | .0068 | .0081 | .0010 | 11.13 | .18 | <.01 | .51 | .009 | .051 | .20 | .26 | .088 | .022 | .029 | .0001 | .162 | 80% |
| V3415 | .0076 | .0043 | .0016 | 11.13 | .28 | <.01 | .36 | .007 | .054 | .18 | .25 | .083 | .023 | .034 | <.0002 | .172 | 78% |
| V3414 | .0083 | .0044 | .0019 | 11.09 | .24 | <.01 | .36 | .006 | .050 | .18 | .25 | .082 | .025 | .031 | <.0002 | .176 | 74% |
| V3444 | .0119 | .0166 | .0020 | 11.11 | .28 | <.01 | .36 | .023 | .050 | .20 | .25 | .081 | .025 | .030 | <.0002 | .202 | 25% |
| V3408 | .0055 | .0056 | .0018 | 11.14 | .30 | <.01 | .37 | .008 | .051 | .21 | .26 | .084 | .027 | .028 | <.0002 | .210 | 74% |
| V3296 | .0062 | .0082 | .0011 | 11.17 | .19 | <.01 | .52 | .006 | .050 | .21 | .25 | .089 | .017 | .032 | .0016 | .260 | 60% |
| V3411 | .0070 | .0062 | .0022 | 11.11 | .22 | <.01 | .36 | .005 | .050 | .15 | .25 | .082 | .023 | .028 | <.0002 | .262 | 57% |
| V3422 | .0090 | .0047 | .0017 | 11.10 | .32 | <.01 | .36 | .005 | .057 | .19 | .26 | .083 | .025 | .030 | <.0002 | .276 | 20% |
| V3298 | .0084 | .0104 | .0011 | 11.08 | .18 | <.01 | .52 | .006 | .049 | .25 | .30 | .090 | .022 | .030 | .0015 | .312 | 70% |
| V3300 | .0081 | .0111 | .0009 | 11.17 | .21 | <.01 | .52 | .007 | .050 | .19 | .25 | .090 | .022 | .030 | .0015 | .333 | 70% |
| V3299 | .0063 | .0087 | .0010 | 11.24 | .18 | <.01 | .32 | .004 | .050 | .19 | .26 | .090 | .024 | .029 | .0014 | .392 | 60% |
| V3297 | .0051 | .0066 | .0011 | 11.27 | .19 | <.01 | .52 | .003 | .051 | .15 | .20 | .091 | .023 | .030 | .0014 | .418 | 70% |
| V3302 | .0064 | .0091 | .0011 | 11.14 | .20 | <.01 | .32 | .004 | .050 | .19 | .26 | .088 | .019 | .029 | .0014 | .455 | 60% |
| V3443 | .0117 | .0199 | .0020 | 11.17 | .29 | <.01 | .36 | .008 | .061 | .26 | .26 | .084 | .025 | .031 | <.0002 | .721 | 65% |

TABLE 2

| HT# | C | N | S | Cr | Ti | Cb | Si | Al | Mo | Ni | Mn | Cu | P | Co | V | Sn | B | Ca | TNA | % EQ |
|---|---|---|---|---|---|---|---|---|---|---|---|---|---|---|---|---|---|---|---|---|
| 971375 | .007 | .0077 | .001 | 11.05 | .19 | .003 | .31 | .006 | .03 | .16 | .13 | .10 | .022 | .02 | .026 | .008 | .0002 | .0012 | 0.244 | 100% |
| 871041 | .008 | .0090 | .001 | 10.69 | .19 | .003 | .16 | .005 | .03 | .13 | .12 | .09 | .023 | .02 | .025 | .009 | .0001 | .0009 | 0.342 | 100% |
| 871218 | .011 | .0079 | .001 | 11.05 | .18 | .003 | .54 | .010 | .03 | .75 | .60 | .07 | .021 | .03 | .023 | .009 | .0003 | .0007 | 0.142 | 95% |
| 871218 | .011 | .0079 | .001 | 11.05 | .18 | .003 | .54 | .010 | .03 | .75 | .60 | .07 | .021 | .03 | .023 | .009 | .0003 | .0007 | 0.142 | 73% |
| 871218 | .011 | .0079 | .001 | 11.05 | .18 | .003 | .54 | .010 | .03 | .75 | .60 | .07 | .021 | .03 | .023 | .009 | .0003 | .0007 | 0.142 | 57% |
| 871567 | .012 | .0075 | .001 | 10.96 | .20 | .004 | .52 | .008 | .02 | .79 | .59 | .06 | .019 | .03 | .024 | .009 | .0003 | .0005 | 0.188 | 78% |
| 972007 | .009 | .0107 | .001 | 10.84 | .19 | .002 | .24 | .011 | .03 | .14 | .15 | .07 | .018 | .02 | .021 | .012 | .0002 | .0009 | 0.185 | 89% |
| 871617 | .006 | .0078 | .002 | 10.82 | .20 | .004 | .19 | .013 | .02 | .13 | .25 | .09 | .019 | .01 | .029 | .013 | .0001 | .0009 | 0.120 | 0% |
| 871613 | .011 | .0080 | .002 | 10.88 | .20 | .007 | .19 | .014 | .03 | .12 | .28 | .09 | .021 | .02 | .028 | .010 | .0003 | .0009 | 0.114 | 6% |
| 972006 | .005 | .0077 | .007 | 10.88 | .19 | .002 | .18 | .014 | .04 | .12 | .15 | .09 | .018 | .02 | .024 | .010 | .0002 | .0007 | 0.105 | 0% |
| 971221 | .006 | .0091 | .001 | 11.05 | .18 | .005 | .33 | .015 | .03 | .15 | .27 | .10 | .024 | .01 | .040 | .011 | .0003 | .0011 | 0.109 | 13% |
| 871609 | .006 | .0111 | .001 | 11.25 | .21 | .004 | .27 | .016 | .02 | .11 | .23 | .09 | .017 | .01 | .028 | .015 | .0003 | .0008 | 0.146 | 63% |
| 971999 | .008 | .0088 | .002 | 11.14 | .21 | .003 | .29 | .017 | .02 | .11 | .25 | .07 | .017 | .02 | .030 | .012 | .0001 | .0010 | 0.109 | 0% |
| 871634 | .010 | .0093 | .001 | 10.99 | .19 | .004 | .45 | .018 | .02 | .22 | .24 | .05 | .015 | .02 | .031 | .007 | .0004 | .0014 | 0.098 | 11% |
| 971459 | .006 | .0068 | .001 | 10.96 | .21 | .005 | .33 | .018 | .03 | .15 | .19 | .10 | .021 | .02 | .034 | .010 | .0002 | .0010 | 0.079 | 25% |
| 871136 | .011 | .0076 | .002 | 11.09 | .19 | .006 | .15 | .019 | .03 | .16 | .22 | .10 | .021 | .01 | .035 | .011 | .0003 | .0009 | 0.076 | 0% |

TABLE 2-continued

| HT# | C | N | S | Cr | Ti | Cb | Si | Al | Mo | Ni | Mn | Cu | P | Co | V | Sn | B | Ca | TNA | % EQ |
|---|---|---|---|---|---|---|---|---|---|---|---|---|---|---|---|---|---|---|---|---|
| 971376 | .007 | .0100 | .001 | 10.56 | .18 | .004 | .17 | .022 | .03 | .14 | .22 | .10 | .020 | .02 | .029 | .009 | .0001 | .0010 | 0.082 | 0% |
| 971222 | .008 | .0077 | .001 | 11.18 | .19 | .009 | .29 | .023 | .03 | .15 | .20 | .10 | .025 | .01 | .033 | .016 | .0002 | .0011 | 0.064 | 18% |
| 971456 | .007 | .0090 | .001 | 11.03 | .20 | .004 | .30 | .024 | .03 | .14 | .20 | .11 | .021 | .01 | .030 | .011 | .0002 | .0011 | 0.075 | 14% |
| 871197 | .006 | .0064 | .001 | 10.95 | .23 | .004 | .35 | .025 | .03 | .15 | .18 | .10 | .023 | .01 | .034 | .010 | .0002 | .0012 | 0.059 | 18% |
| 950626 | .010 | .0095 | .001 | 11.00 | .18 | .002 | .51 | .061 | .03 | .23 | .22 | .09 | .023 | .02 | .031 | .007 | .0002 | .0011 | 0.028 | 11% |
| 960878 | .010 | .0076 | .001 | 11.35 | .21 | .005 | .51 | .053 | .05 | .18 | .23 | .08 | .023 | .02 | .032 | .009 | .0003 | .0012 | 0.030 | 12% |
| 960592 | .010 | .0080 | .001 | 11.05 | .17 | .004 | .48 | .042 | .03 | .15 | .27 | .08 | .022 | .01 | .028 | .008 | .0002 | .0012 | 0.032 | 0% |
| 880086 | .008 | .0064 | .001 | 11.18 | .22 | .005 | .24 | .006 | .03 | .12 | .26 | .09 | .019 | .02 | .029 | .007 | .0002 | .0004 | 0.235 | 100% |
| 980109 | .006 | .0060 | .002 | 11.16 | .21 | .005 | .22 | .005 | .03 | .13 | .26 | .09 | .019 | .02 | .031 | .007 | .0001 | .0005 | 0.252 | 100% |
| 880150 | .007 | .0072 | .002 | 11.09 | .20 | .004 | .31 | .005 | .03 | .14 | .23 | .10 | .022 | .02 | .028 | .010 | .0002 | .0010 | 0.288 | 57% |
| 880150 | .007 | .0072 | .002 | 11.09 | .20 | .004 | .31 | .005 | .03 | .14 | .23 | .10 | .022 | .02 | .028 | .010 | .0002 | .0010 | 0.288 | 92% |
| 880151 | .009 | .0081 | .001 | 11.13 | .19 | .005 | .43 | .011 | .03 | .14 | .24 | .10 | .021 | .02 | .028 | .008 | .0002 | .0010 | 0.140 | 92% |
| 880151 | .009 | .0081 | .001 | 11.13 | .19 | .005 | .43 | .011 | .03 | .14 | .24 | .10 | .021 | .02 | .028 | .008 | .0002 | .0010 | 0.140 | 83% |
| 980182 | .010 | .0067 | .001 | 11.12 | .23 | .004 | .31 | .008 | .03 | .13 | .27 | .09 | .021 | .02 | .028 | .011 | .0003 | .0004 | 0.193 | 92% |
| 880152 | .006 | .0060 | .002 | 11.04 | .21 | .005 | .30 | .006 | .02 | .12 | .28 | .08 | .020 | .02 | .027 | .008 | .0001 | .0004 | 0.210 | 91% |
| 880153 | .008 | .0064 | .001 | 11.13 | .20 | .004 | .31 | .008 | .03 | .12 | .26 | .08 | .021 | .02 | .026 | .008 | .0002 | .0004 | 0.160 | 80% |
| 980183 | .007 | .0074 | .001 | 11.14 | .21 | .003 | .33 | .008 | .03 | .13 | .27 | .09 | .024 | .02 | .030 | .008 | .0001 | .0004 | 0.194 | 95% |
| 880154 | .005 | .0069 | .002 | 11.17 | .20 | .004 | .31 | .006 | .03 | .14 | .26 | .09 | .021 | .02 | .027 | .009 | .0001 | .0003 | 0.230 | 95% |
| 980194 | .007 | .0050 | .001 | 11.16 | .21 | .004 | .32 | .009 | .03 | .15 | .30 | .09 | .025 | .02 | .032 | .006 | .0001 | .0004 | 0.117 | 0% |
| 880191 | .010 | .0052 | .001 | 11.03 | .23 | .004 | .31 | .009 | .02 | .14 | .26 | .10 | .021 | .02 | .029 | .007 | .0003 | .0004 | 0.133 | 72% |
| 880191 | .010 | .0052 | .001 | 11.03 | .23 | .004 | .31 | .009 | .02 | .14 | .26 | .10 | .021 | .02 | .029 | .007 | .0003 | .0004 | 0.133 | 84% |
| 880191 | .010 | .0052 | .001 | 11.03 | .23 | .004 | .31 | .009 | .02 | .14 | .26 | .10 | .021 | .02 | .029 | .007 | .0003 | .0004 | 0.133 | 0% |
| 980460 | .013 | .0076 | .001 | 11.17 | .20 | .004 | .32 | .006 | .03 | .94 | .53 | .09 | .018 | .03 | .024 | .006 | .0003 | .0005 | 0.253 | 54% |
| 980460 | .013 | .0076 | .001 | 11.17 | .20 | .004 | .32 | .006 | .03 | .94 | .53 | .09 | .018 | .03 | .024 | .006 | .0003 | .0005 | 0.253 | 35% |
| 980460 | .013 | .0076 | .001 | 11.17 | .20 | .004 | .32 | .006 | .03 | .94 | .53 | .09 | .018 | .03 | .024 | .006 | .0003 | .0005 | 0.253 | 81% |
| 980461 | .010 | .0062 | .001 | 11.10 | .21 | .004 | .32 | .008 | .02 | .94 | .54 | .11 | .018 | .03 | .027 | .006 | .0003 | .0005 | 0.163 | 81% |
| 980482 | .007 | .0059 | .001 | 11.09 | .24 | .004 | .31 | .008 | .02 | .12 | .21 | .08 | .019 | .02 | .029 | .006 | .0002 | .0005 | 0.177 | 92% |
| 880406 | .007 | .0054 | .002 | 11.18 | .21 | .004 | .32 | .007 | .03 | .14 | .22 | .10 | .023 | .02 | .027 | .010 | .0002 | .0004 | 0.162 | 65% |
| 880424 | .006 | .0062 | .001 | 11.13 | .20 | .003 | .33 | .009 | .03 | .12 | .23 | .11 | .018 | .01 | .024 | .025 | .0002 | .0004 | 0.138 | 89% |
| 880460 | .009 | .0058 | .001 | 11.05 | .19 | .003 | .41 | .008 | .03 | .13 | .27 | .13 | .021 | .01 | .026 | .007 | .0003 | .0004 | 0.138 | 0% |
| 980559 | .008 | .0057 | .002 | 11.17 | .21 | .005 | .32 | .008 | .03 | .15 | .24 | .09 | .020 | .02 | .030 | .008 | .0003 | .0004 | 0.150 | 70% |
| 880461 | .008 | .0081 | .001 | 11.14 | .20 | .003 | .32 | .007 | .03 | .16 | .23 | .08 | .021 | .02 | .028 | .006 | .0003 | .0004 | 0.231 | 85% |
| 880459 | .008 | .0090 | .001 | 11.20 | .20 | .004 | .32 | .006 | .03 | .14 | .24 | .10 | .020 | .01 | .028 | .008 | .0002 | .0004 | 0.300 | 10% |
| 980560 | .007 | .0075 | .001 | 11.10 | .19 | .003 | .34 | .008 | .03 | .13 | .23 | .10 | .020 | .01 | .027 | .007 | .0003 | .0004 | 0.178 | 85% |
| 880462 | .007 | .0059 | .001 | 11.09 | .18 | .005 | .40 | .010 | .02 | .13 | .29 | .10 | .020 | .01 | .028 | .008 | .0003 | .0004 | 0.106 | 0% |
| 980561 | .007 | .0068 | .002 | 11.11 | .21 | .006 | .32 | .006 | .02 | .12 | .30 | .09 | .020 | .01 | .029 | .006 | .0003 | .0004 | 0.238 | 85% |
| 880463 | .007 | .0064 | .001 | 11.09 | .18 | .004 | .37 | .007 | .02 | .11 | .25 | .09 | .019 | .02 | .028 | .007 | .0003 | .0004 | 0.165 | 0% |
| 980646 | .008 | .0059 | .001 | 11.09 | .25 | .004 | .32 | .009 | .02 | .12 | .28 | .08 | .019 | .02 | .029 | .007 | .0002 | .0004 | 0.164 | 92% |
| 880535 | .008 | .0062 | .001 | 11.22 | .24 | .003 | .30 | .007 | .02 | .13 | .23 | .09 | .020 | .02 | .027 | .010 | .0002 | .0005 | 0.213 | 92% |
| 880540 | .007 | .0065 | .002 | 11.13 | .22 | .003 | .32 | .008 | .03 | .12 | .24 | .08 | .019 | .02 | .029 | .007 | .0002 | .0004 | 0.179 | 92% |
| 980655 | .008 | .0064 | .003 | 11.22 | .21 | .003 | .33 | .006 | .03 | .12 | .17 | .09 | .021 | .02 | .025 | .007 | .0001 | .0006 | 0.224 | 25% |
| 980659 | .005 | .0065 | .001 | 11.07 | .22 | .003 | .30 | .008 | .03 | .14 | .18 | .11 | .019 | .02 | .027 | .010 | .0001 | .0005 | 0.179 | 100% |
| 880565 | .007 | .0062 | .001 | 11.20 | .20 | .003 | .30 | .007 | .03 | .13 | .25 | .10 | .020 | .02 | .026 | .007 | .0002 | .0002 | 0.177 | 100% |
| 980687 | .007 | .0060 | .002 | 11.25 | .21 | .005 | .30 | .006 | .04 | .13 | .29 | .11 | .020 | .02 | .028 | .007 | .0002 | .0004 | 0.210 | 23% |
| 980694 | .007 | .0067 | .001 | 11.10 | .22 | .004 | .30 | .006 | .03 | .12 | .31 | .09 | .020 | .01 | .028 | .007 | .0001 | .0004 | 0.246 | 73% |
| 980712 | .007 | .0068 | .002 | 11.12 | .20 | .004 | .33 | .006 | .03 | .14 | .24 | .09 | .019 | .02 | .031 | .008 | .0002 | .0005 | 0.227 | 92% |
| 980717 | .007 | .0067 | .002 | 11.07 | .22 | .004 | .31 | .007 | .03 | .12 | .24 | .10 | .018 | .02 | .031 | .011 | .0002 | .0005 | 0.211 | 88% |
| 880609 | .009 | .0069 | .002 | 11.22 | .21 | .004 | .27 | .005 | .03 | .12 | .27 | .10 | .019 | .02 | .034 | .007 | .0002 | .0004 | 0.290 | 54% |
| 980741 | .010 | .0069 | .002 | 11.03 | .20 | .004 | .30 | .006 | .03 | .12 | .23 | .08 | .019 | .03 | .030 | .007 | .0001 | .0005 | 0.230 | 100% |

TABLE 3

| ID | C | N | S | Cr | Ti | Cb | Si | Al | Mo | Ni | Mn | Cu | P | V | Ca | TNA | % EQ |
|---|---|---|---|---|---|---|---|---|---|---|---|---|---|---|---|---|---|
| V3371 | .039 | .038 | .002 | 16.86 | .02 | <.01 | .42 | <.003 | .050 | .18 | .36 | .095 | .018 | .048 | — | 0.279 | 0% |
| V3372 | .040 | .039 | .002 | 16.93 | .05 | <.01 | .43 | .007 | .049 | .21 | .36 | .094 | .019 | .048 | — | 0.290 | 4% |
| V3373 | .040 | .038 | .002 | 16.95 | .10 | <.01 | .42 | .008 | .052 | .21 | .36 | .093 | .018 | .047 | — | 0.470 | 59% |
| V3374 | .031 | .015 | .002 | 16.94 | .01 | <.01 | .42 | .008 | .050 | .21 | .36 | .094 | .020 | .047 | — | 0.025 | 25% |
| V3375 | .029 | .014 | .002 | 16.92 | .06 | <.01 | .42 | .009 | .049 | .20 | .35 | .093 | .023 | .049 | — | 0.092 | 0% |
| V3376 | .032 | .015 | .002 | 17.01 | .10 | <.01 | .42 | .010 | .050 | .21 | .36 | .093 | .022 | .048 | — | 0.144 | 0% |
| V3403 | .041 | .039 | .002 | 16.84 | .12 | <.01 | .42 | .003 | .051 | .22 | .36 | .099 | .024 | .045 | <.0002 | 1.560 | 83% |
| V3427 | .033 | .025 | .002 | 16.84 | .12 | <.01 | .41 | .006 | .054 | .22 | .36 | .100 | .025 | .047 | <.0002 | 0.500 | 100% |
| V3402 | .030 | .015 | .002 | 16.79 | .12 | <.01 | .42 | .003 | .050 | .21 | .36 | .099 | .024 | .046 | <.0002 | 0.600 | 9% |
| V3428 | .033 | .016 | .002 | 16.87 | .21 | <.01 | .42 | .007 | .050 | .22 | .36 | .100 | .027 | .050 | <.0002 | 0.480 | 86% |
| V3394 | .009 | .011 | .002 | 17.52 | .32 | <.01 | .32 | .059 | .051 | .20 | .26 | .094 | .025 | .046 | .0009 | 0.061 | 24% |
| V3391 | .010 | .012 | .005 | 17.70 | .28 | <.01 | .32 | .056 | .050 | .20 | .25 | .095 | .024 | .048 | .0007 | 0.058 | 23% |
| V3390 | .010 | .012 | .005 | 17.72 | .27 | <.01 | .32 | .022 | .051 | .20 | .25 | .094 | .025 | .051 | .0009 | 0.147 | 37% |
| V3389 | .011 | .012 | .005 | 17.72 | .26 | <.01 | .32 | .014 | .050 | .19 | .26 | .095 | .026 | .047 | .0008 | 0.228 | 85% |
| V3392 | .011 | .012 | .003 | 17.48 | .30 | <.01 | .31 | .011 | .050 | .19 | .25 | .093 | .026 | .048 | .0009 | 0.327 | 73% |
| V3388 | .010 | .011 | .004 | 17.00 | .26 | <.01 | .31 | .012 | .048 | .20 | .24 | .091 | .022 | .051 | <.0002 | 0.241 | 72% |
| V3393 | .008 | .013 | .004 | 17.52 | .31 | <.01 | .32 | .010 | .051 | .20 | .26 | .096 | .026 | .049 | <.0002 | 0.403 | 79% |
| V3387 | .010 | .011 | .003 | 17.71 | .28 | <.01 | .33 | .004 | .050 | .19 | .26 | .095 | .025 | .048 | .0008 | 0.756 | 65% |
| V3370 | .009 | .012 | .001 | 17.71 | .29 | <.01 | .31 | <.003 | .044 | .21 | .25 | .094 | .024 | .058 | — | 1.160 | 50% |
| V3421 | .009 | .014 | .002 | 17.43 | .31 | <.01 | .31 | .061 | .050 | .21 | .25 | .100 | .025 | .048 | .0008 | 0.071 | 21% |

TABLE 3-continued

| ID | C | N | S | Cr | Ti | Cb | Si | Al | Mo | Ni | Mn | Cu | P | V | Ca | TNA | % EQ |
|---|---|---|---|---|---|---|---|---|---|---|---|---|---|---|---|---|---|
| V3424 | .009 | .012 | .003 | 17.43 | .32 | <.01 | .32 | .061 | .980 | .25 | .26 | .110 | .028 | .044 | .0008 | 0.065 | 35% |
| V3420 | .010 | .014 | .002 | 17.37 | .35 | <.01 | .32 | .059 | 1.300 | .25 | .26 | .100 | .027 | .048 | .0008 | 0.085 | 29% |
| V3417 | .009 | .016 | .002 | 17.46 | .32 | <.01 | .31 | .004 | .060 | .25 | .26 | .100 | .026 | .049 | <.0002 | 1.240 | 79% |
| V3418 | .009 | .013 | .002 | 17.45 | .34 | <.01 | .32 | .005 | .990 | .23 | .26 | .110 | .026 | .048 | <.0002 | 0.870 | 74% |
| V3419 | .007 | .014 | .002 | 17.47 | .34 | <.01 | .32 | .006 | 1.300 | .25 | .26 | .110 | .027 | .047 | <.0002 | 0.810 | 74% |

The compositions, TNA and % EQ for still other as-cast laboratory ingots for comparative and inventive Type 430, Type 439 and Type 439Mo high chromium stainless melts produced and cast similar to the ingots of Examples 1–4 are summarized in Table 3. Table 3 demonstrates that Ti of at least about 0.10% and a TNA, i.e., (Ti×N)/Al, of at least about 0.20 are necessary to obtain an as-cast steel grain structure containing at least 50% fine equiaxed grains. The increase in TNA apparently was necessitated because of the chromium increase from about 11% for the Type 409 stainless in Table 1 to a high chromium composition of about 17% or more for the Type 430, Type 439 and Type 439Mo high chromium stainless steels in Table 3.

EXAMPLE 5

Figure 5:
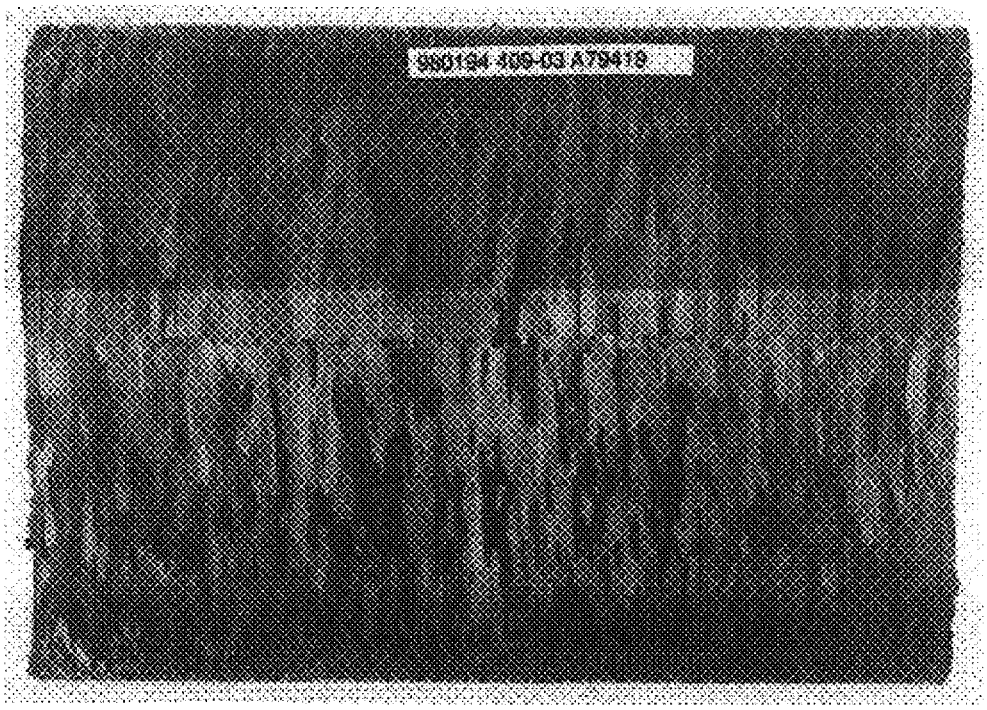
FIG. 5 is a photograph of an as-cast structure containing 100% large columnar grains for a ferritic chromium alloyed steel having a ratio of the product of titanium and nitrogen divided by aluminum of 0.12.

A comparative chromium alloyed ferrous melt of about 125 metric tons was provided in an AOD refining vessel. After carbon was reduced to the final specification, the melt was transferred to a LMF wherein final trim alloying elements were added. Thereafter, the melt was deoxidized with titanium. The final composition of the melt was 0.009% Al, 0.21% Ti, 0.007% C, 0.26% Mn, 0.32% Si, 11.2% Cr, 0.14% Ni and 0.005% N. The ratio of the product of titanium and nitrogen divided by aluminum was 0.12. The steel melt then was transferred to a caster within about 40 minutes and continuously cast into thin slabs having a thickness of 130 mm and a width of 1200 mm. Cross-section pieces were cut from a mid-width position and at several other locations along the length of the thin slab. A typical as-cast grain structure of one of these pieces cut from a slab of this steel is illustrated in FIG. 5 and had a columnar grain structure having an average column size of about 4 mm. This steel, like that of Example 1, demonstrates having low aluminum alone, i.e., ≦0.01%, is not sufficient to form an as-cast structure of predominantly equiaxed grains. FIG. 5 illustrates a ferritic stainless steel having a ratio of (Ti×N)/Al<0.14 results in as-cast steel grain structure containing no equiaxed grains.

EXAMPLE 6

Figure 6:
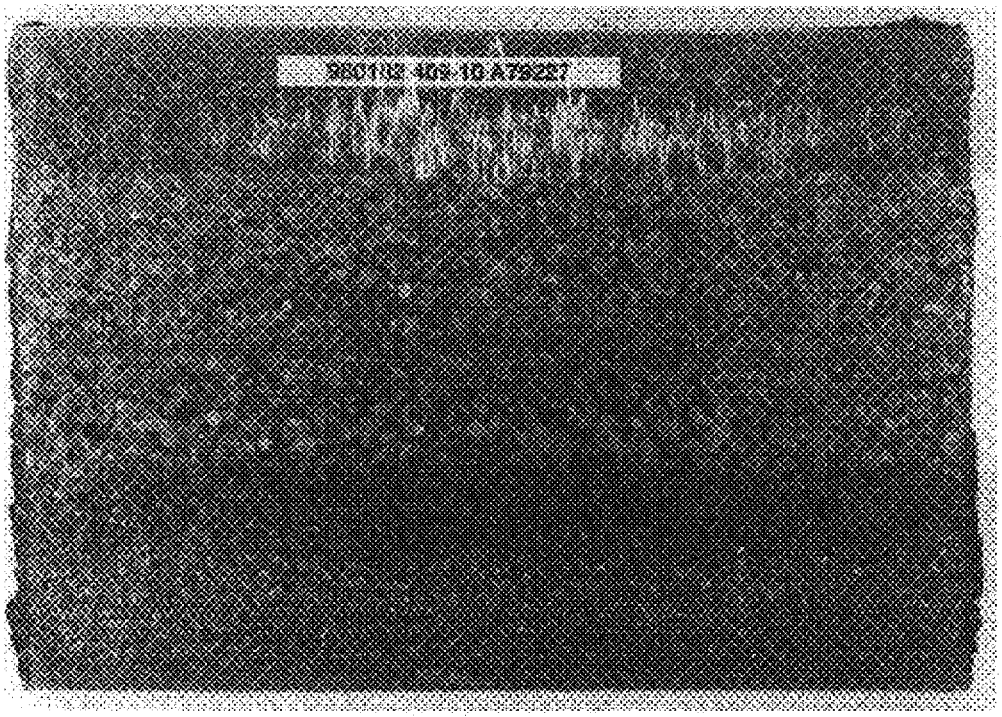
FIG. 6 is a photograph of an as-cast structure containing about 92% fine equiaxed grains for a ferritic chromium alloyed steel having a ratio of the product of titanium and nitrogen divided by aluminum of 0.19.

A chromium alloyed ferrous melt of the invention of about 125 metric tons was produced in a manner similar to that described above for Example 5 except for the following composition changes. The composition of the melt was 0.23% Ti, 0.008% Al, 0.010% C, 0.27% Mn, 0.31% Si, 11.1% Cr, 0.13% Ni and 0.007% N. Unlike Example 5, the ratio of the product of titanium and nitrogen divided by aluminum was increased to 0.19. The steel melt then was transferred to a caster and cast into thin slabs in a manner similar to that described above for Example 5. An as-cast grain structure of a slab of this stainless steel had a fine grain structure of about 84% equiaxed grains and an average size of about 2 mm as illustrated in FIG. 6. FIG. 6 illustrates a ferritic stainless steel having a ratio (Ti×N)/Al≧0.14 results in an as-cast steel grain structure containing >50% equiaxed grains. The slabs of this steel contained inclusions primarily of titanium oxides.

EXAMPLE 7

Figure 7:
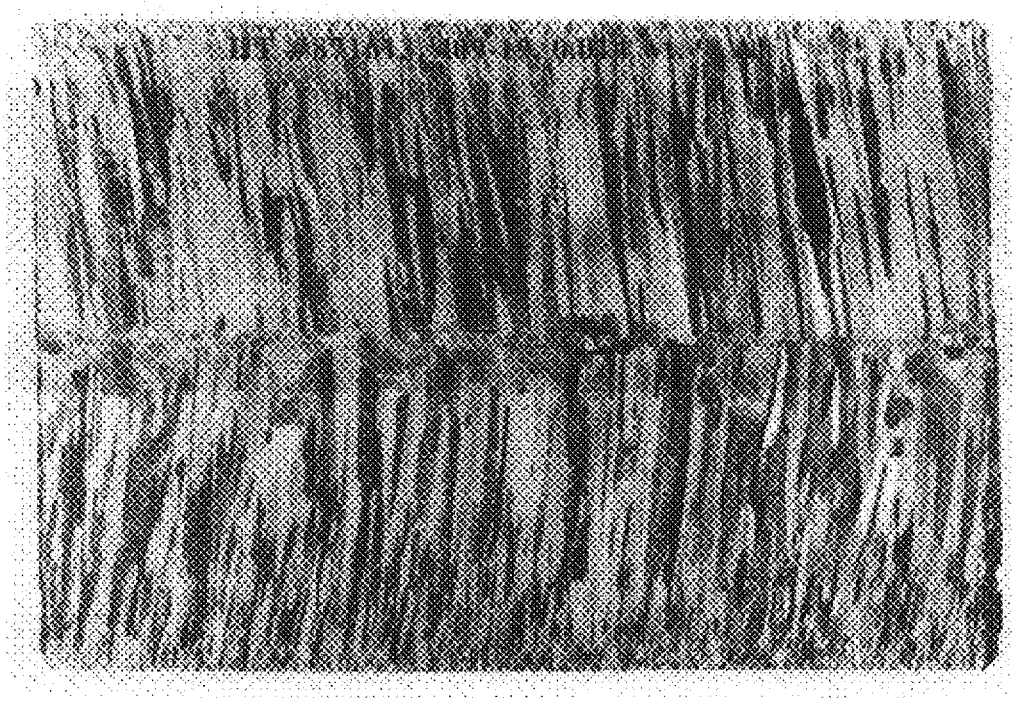
FIG. 7 is a photograph of an as-cast structure containing about 94% large columnar grains for a ferritic chromium alloyed steel having a ratio of the product of titanium and nitrogen divided by aluminum of 0.11.

Another comparative chromium alloyed ferrous melt was produced similar to that of Example 5. The composition of the melt was 0.20% Ti, 0.014% Al, 0.011% C, 0.28% Mn, 0.31% Si, 10.9% Cr, 0.12% Ni and 0.0087% N. Similar to Example 5, the ratio of the product of titanium and nitrogen divided by aluminum was only 0.11. The steel melt then was transferred to a caster and cast into thin slabs in a manner similar to that described above for Example 5. An as-cast grain structure of a slab of this stainless steel had about 94% large columnar grains having an average column size of about 5 mm as illustrated in FIG. 7. FIG. 7 illustrates a ferritic stainless steel having a ratio (Ti×N)/Al<0.14 results in an as-cast steel grain structure containing very few equiaxed grains.

EXAMPLE 8

Figure 8:
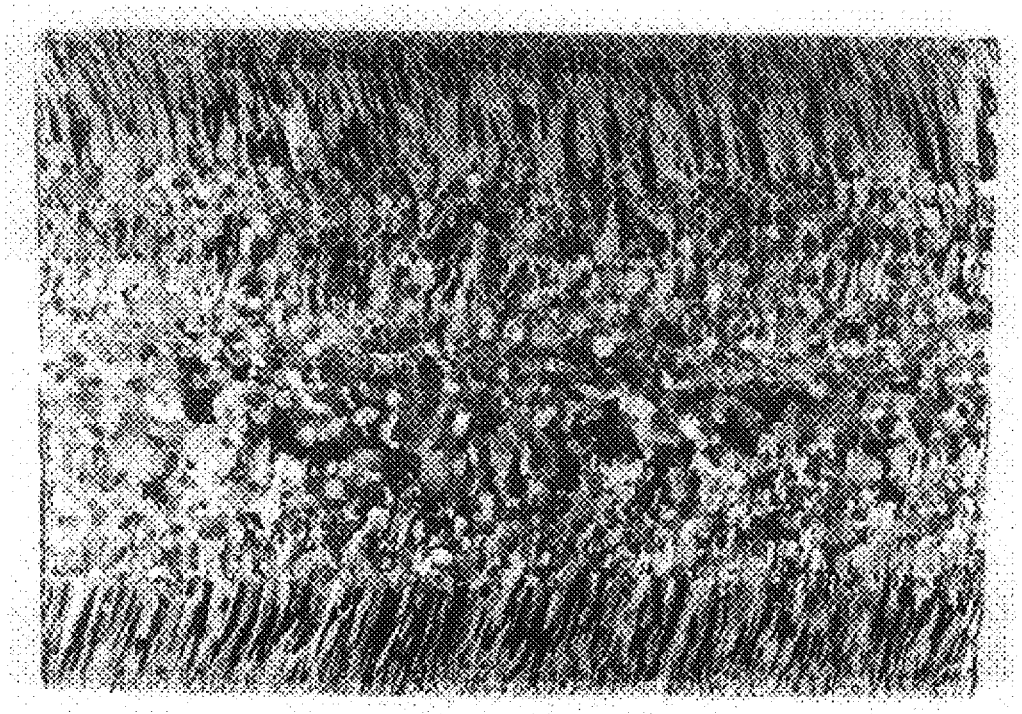
FIG. 8 is a photograph of an as-cast structure containing about 63% fine equiaxed grains for a ferritic chromium alloyed steel having a ratio of the product of titanium and nitrogen divided by aluminum of 0.15.

Another chromium alloyed ferrous melt of the invention was produced similar to that of Example 6. The composition of the melt was 0.21% Ti, 0.016% Al, 0.006% C, 0.23% Mn, 0.27% Si, 11.3% Cr, 0.11% Ni and 0.011% N. The ratio of the product of titanium and nitrogen divided by aluminum was 0.15. The steel melt then was transferred to a caster and cast into thin slabs in a manner similar to that described above for Example 5. An as-cast grain structure of a piece cut from a slab of this stainless steel had a predominantly fine equiaxed grain structure as illustrated in FIG. 8. FIG. 8 illustrates a ferritic stainless steel having a ratio of (Ti×N)/Al≧0.14 resulted in an as-cast steel grain structure containing 63% fine equiaxed grains having a size of about 3 mm. This steel illustrates that an as-cast steel grain structure can contain ≧50% fine equiaxed grains even though the steel has high aluminum, i.e., ≧0.01%, if the ratio (Ti×N)/Al≧0.14. The slabs of this steel contained inclusions primarily of titanium oxides.

EXAMPLE 9

Figure 9:
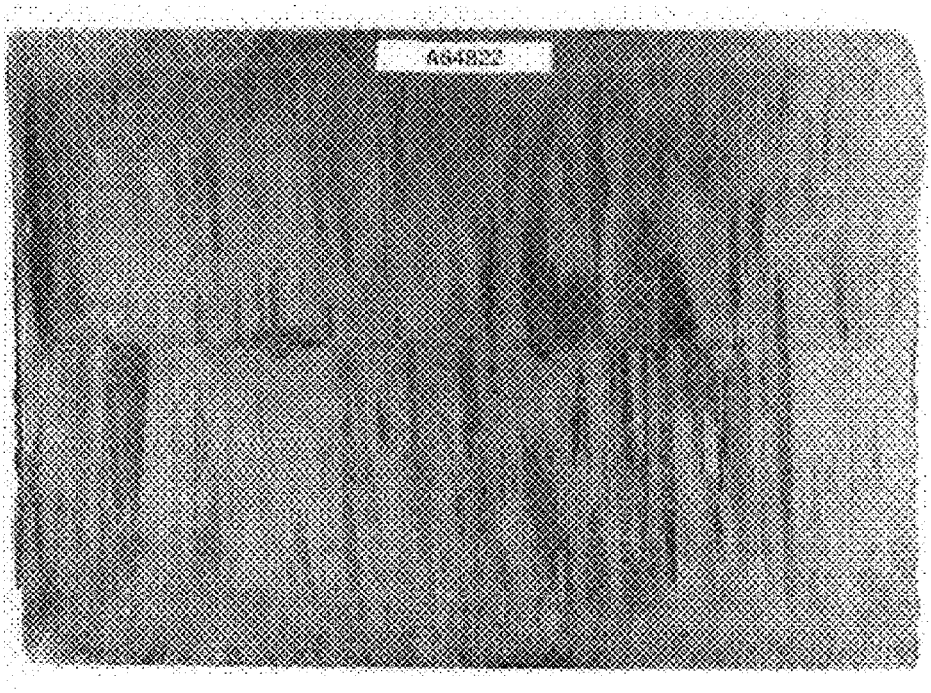
FIG. 9 is a photograph of an as-cast structure containing 100% large columnar grains for a ferritic chromium alloyed steel having a ratio of the product of titanium and nitrogen divided by aluminum of 0.06.

Another comparative chromium alloyed ferrous melt was produced similar to that of Example 5. The composition of the melt was 0.18% Ti, 0.022% Al, 0.007% C, 0.22% Mn, 0.17% Si, 10.6% Cr, 0.14% Ni and 0.010% N. The ratio of the product of titanium and nitrogen divided by aluminum was only 0.08. The steel melt then was transferred to a caster and cast into thin slabs in a manner similar to that described above for Example 5. An as-cast grain structure of a slab of this stainless steel had a large grain structure that was 100% columnar grain structure having an average column size of about 4 mm as illustrated in FIG. 9. FIG. 9 illustrates a ferritic stainless steel having a ratio (Ti×N)/Al<0.14 results in an as-cast steel grain structure containing no equiaxed grains.

Figure 11:
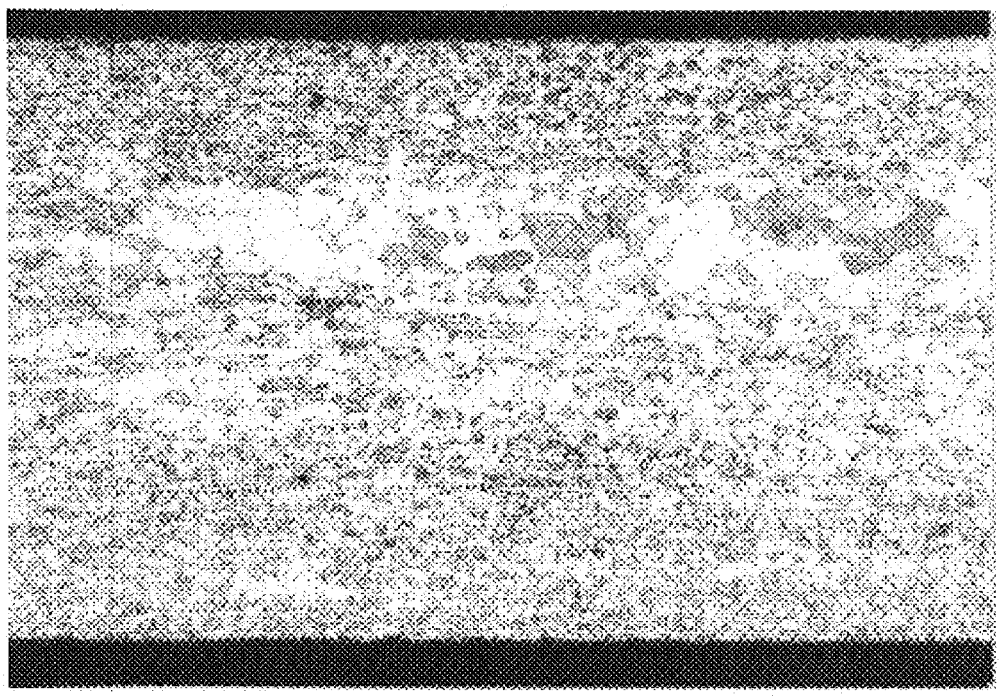
FIG. 11 is a photograph of a non-uniform banded grain structure of the comparative ferritic chromium alloyed steel of FIG. 9 after cold reduction and recrystallization annealing.

Slabs cast from this melt were reheated to 1250° C., hot processed to a thickness of 3.3 mm with a finishing temperature of about 800° C. and coiled at a temperature of about 700° C. The hot processed sheet was descaled, pickled in nitric and hydrofluoric acid and cold reduced 58% to a thickness of 1.4 mm. This hot processed sheet was not annealed prior to cold reduction. The cold reduced sheet was annealed at peak metal temperature of 870° C. for about 60 seconds. After stretching, the ridging characteristic on the sheet was 3–4 and had an grain structure of 1.22–1.27. A ridging characteristic of 3 or more means moderate to severe ridging on a scale of 0–6. A high ridging characteristic of 3 or more and a low grain structure of less than 1.3 are unacceptable for many deep formability, exposed, ferritic stainless steel applications. The mechanical properties for this steel are summarized in Table 5. A cold rolled, annealed grain structure of this steel is shown in FIG. 11 exhibiting a non-uniform "banded" grain structure characteristic of steels prone to ridging. This non-uniform banded grain structure is not acceptable for exposed ferritic stainless steel applications requiring high formability. Annealed cold reduced sheet produced from a slab having a columnar grain structure will experience severe ridging characteristics unless a sheet hot rolled from the slab is annealed prior to cold reduction.

EXAMPLE 10

Figure 10:
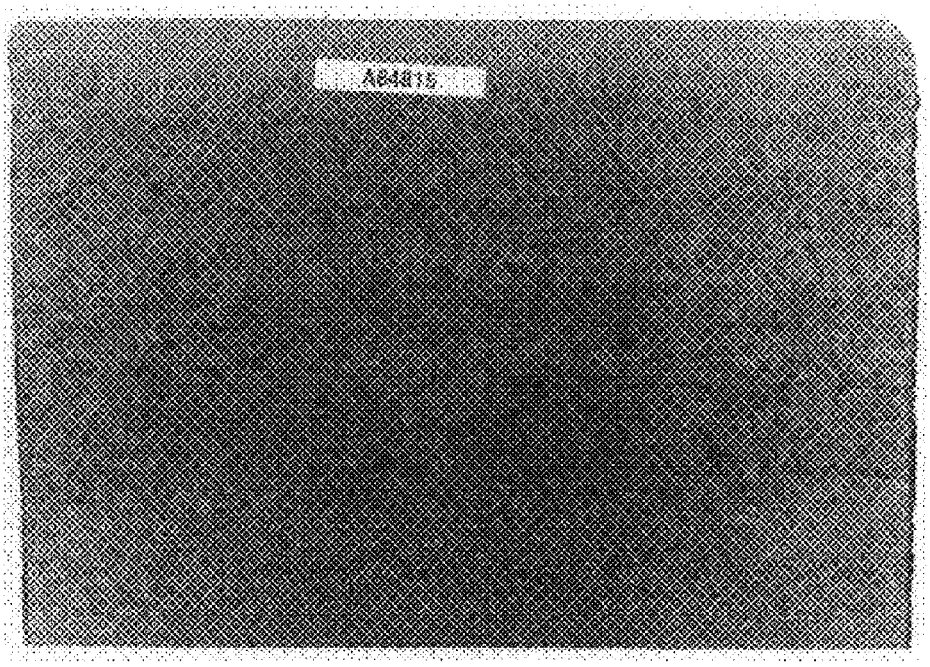
FIG. 10 is a photograph of an as-cast structure containing about 100% fine equiaxed grains for a ferritic chromium alloyed steel having a ratio of the product of titanium and nitrogen divided by aluminum of 0.34.

Another chromium alloyed ferrous melt of the invention was produced similar to that of Example 8. The composition of the melt was 0.19% Ti, 0.005% Al, 0.008% C, 0.12% Mn, 0.16% Si, 10.7% Cr, 0.13% Ni and 0.011% N. The ratio of the product of titanium and nitrogen divided by aluminum was 0.34. The steel melt then was transferred to a caster and cast into thin slabs in a manner similar to that described above for Example 5. FIG. 10 illustrates this ferritic stainless steel having a ratio of (Ti×N)/Al≧0.23 resulted in an as-cast steel grain structure containing 100% fine equiaxed grains having a size of about 1 mm. The slabs of this steel contained inclusions primarily of titanium oxides.

Figure 12:
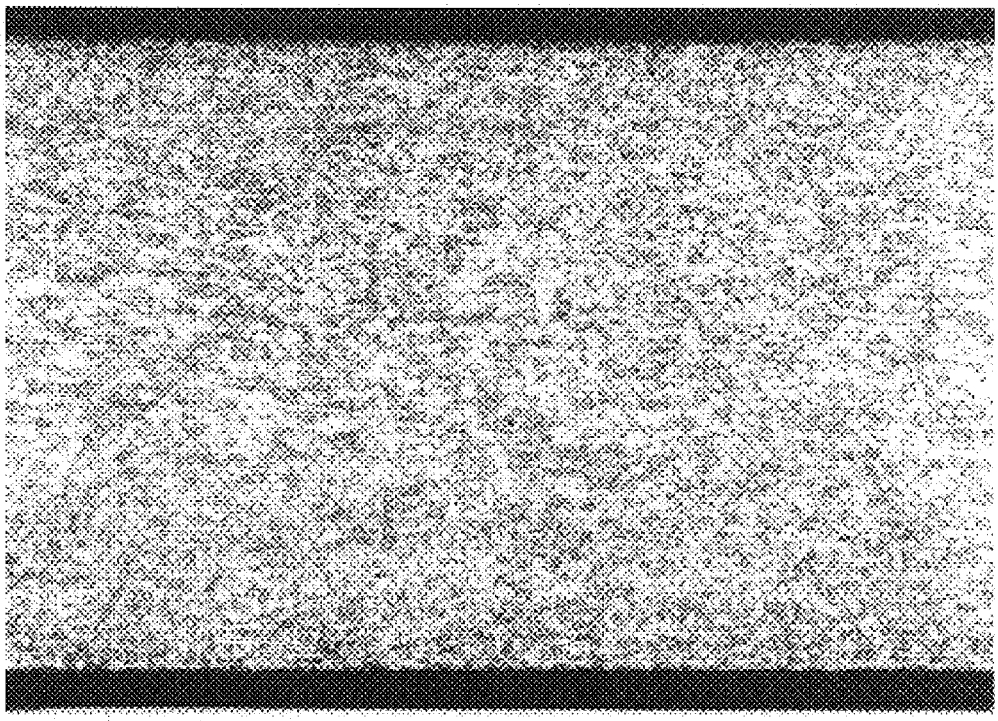
FIG. 12 is a photograph of a uniform fine grain structure of the ferritic chromium alloyed steel of FIG. 10 after cold reduction and recrystallization annealing.

These thin slabs were reheated to 1250° C., hot processed to a thickness of 3.3 mm with a finishing temperature of 800° C. and coiled at a temperature of 700° C. The hot processed sheet was descaled, pickled in nitric and hydrofluoric acid and cold reduced 58% to a thickness of 1.4 mm. This hot processed sheet was not annealed prior to cold reduction. The cold reduced sheet was annealed at a peak metal temperature of 870° C. for 60 seconds. After stretching, the ridging characteristic on the annealed sheet decreased to 1 and had an increase of the $R_m$ to 1.45. A ridging characteristic of 1 means excellent ridging and the steel is essentially free of ridging. A ridging characteristic of 2 or less and an $R_m$ of at least 1.4 are acceptable for most deep forming, exposed ferritic stainless steel applications. Mechanical properties of the sheets of the invention are summarized in Table 6. The cold rolled and annealed grain structure is shown in FIG. 12 exhibiting a very uniform fine grain structure. This annealed cold reduced sheet of the invention produced from a slab having a fine equiaxed grain structure had excellent ridging characteristics even though a hot rolled sheet was not annealed prior to cold reduction.

TABLE 4

| HT# | C | N | S | Cr | Ti | Cb | Si | Al | Mo | Ni | Mn | Cu | P | V | Sn | Ca | TNA | % EQ |
|---|---|---|---|---|---|---|---|---|---|---|---|---|---|---|---|---|---|---|
| 880496 | .043 | .0380 | .001 | 16.51 | .13 | .012 | .35 | .007 | .06 | .23 | .44 | .12 | .026 | .038 | .009 | .0002 | 0.706 | 92% |
| 880496 | .043 | .0380 | .001 | 16.51 | .13 | .012 | .35 | .007 | .06 | .23 | .44 | .12 | .026 | .038 | .009 | .0002 | 0.706 | 92% |
| 980127 | .007 | .0114 | .001 | 17.35 | .35 | .003 | .31 | .014 | .07 | .30 | .24 | .13 | .024 | .039 | .009 | .0002 | .0285 | 100% |
| 980604 | .017 | .0117 | .001 | 17.49 | .28 | .016 | .27 | .010 | .06 | .22 | .24 | .14 | .026 | .034 | .010 | .0002 | .0328 | 58% |
| 980604 | .017 | .0117 | .001 | 17.49 | .28 | .016 | .27 | .010 | .06 | .22 | .24 | .14 | .026 | .034 | .010 | .0002 | .0328 | 75% |
| 980636 | .016 | .0108 | .001 | 17.42 | .38 | .012 | .31 | .011 | .05 | .19 | .22 | .12 | .027 | .033 | .011 | .0002 | 0.373 | 27% |
| 980636 | .016 | .0108 | .001 | 17.42 | .38 | .012 | .31 | .011 | .05 | .19 | .22 | .12 | .027 | .033 | .011 | .0002 | 0.373 | 62% |
| 880530 | .010 | .0104 | .001 | 17.21 | .35 | .014 | .31 | .012 | .05 | .19 | .28 | .12 | .025 | .034 | .012 | .0002 | 0.303 | 92% |
| 880530 | .010 | .0104 | .001 | 17.21 | .35 | .014 | .31 | .012 | .05 | .19 | .28 | .12 | .025 | .034 | .012 | .0002 | 0.303 | 92% |
| 880530 | .010 | .0104 | .001 | 17.21 | .35 | .014 | .31 | .012 | .05 | .19 | .28 | .12 | .025 | .034 | .012 | .0002 | 0.303 | 92% |

TABLE 5

| Longitudinal Tensile | | | | | Transverse Tensile | | | | | | |
|---|---|---|---|---|---|---|---|---|---|---|---|
| YPE % | 0.2% YS ($kg/mm_2$) | UTS ($kg/mm_2$) | Elong. % | $R_B$ | YPE % | 0.2% YS ($kg/mm_2$) | UTS ($kg/mm_2$) | Elong. % | $R_B$ | $r_m$ | Ridging |
| 0.3 | 21 | 41 | 34 | 63 | 0.3 | 22 | 43 | 32 | 63 | 1.24 | 3–4 |

TABLE 6

| Longitudinal Tensile | | | | | Transverse Tensile | | | | | | |
|---|---|---|---|---|---|---|---|---|---|---|---|
| YPE % | 0.2% YS ($kg/mm_2$) | UTS ($kg/mm_2$) | Elong. % | $R_B$ | YPE % | 0.2% YS ($kg/mm_2$) | UTS ($kg/mm_2$) | Elong. % | $R_B$ | $r_m$ | Ridging |
| 0.0 | 21 | 42 | 34 | 64 | 0.6 | 22 | 43 | 34 | 63 | 1.45 | 1 |

TABLE 7

| Longitudinal Tensile | | | | | Transverse Tensile 66% Cold Reduction | | | | | | |
|---|---|---|---|---|---|---|---|---|---|---|---|
| YPE % | 0.2% YS ($kg/mm_2$) | UTS ($kg/mm_2$) | Elong. % | $R_B$ | YPE % | 0.2% YS ($kg/mm_2$) | UTS ($kg/mm_2$) | Elong. % | $R_B$ | $r_m$ | Ridging |
| 0.6 | 21 | 41 | 37 | 64 | 0.6 | 22 | 42 | 36 | 63 | 1.43 | 1–2 |

TABLE 8

| Longitudinal Tensile | | | | | Transverse Tensile | | | | | | |
|---|---|---|---|---|---|---|---|---|---|---|---|
| YPE % | 0.2% YS ($kg/mm_2$) | UTS ($kg/mm_2$) | Elong. % | $R_B$ | YPE % | 0.2% YS ($kg/mm_2$) | UTS ($kg/mm_2$) | Elong. % | $R_B$ | $r_m$ | Ridging |
| | | | | | 66% Cold Reduction | | | | | | |
| 0.4 | 22 | 41 | 36 | 64 | 0.9 | 22 | 41 | 37 | 64 | 1.76 | 1–2 |
| | | | | | 76% Cold Reduction | | | | | | |
| 0.4 | 22 | 41 | 36 | 65 | 0.5 | 22 | 41 | 36 | 66 | 1.96 | 2 |
| | | | | | 85% Cold Reduction | | | | | | |
| 0.3 | 22 | 41 | 34 | — | 0.4 | 22 | 41 | 37 | — | 1.92 | 2–3 |

EXAMPLE 11

Another chromium alloyed ferrous melt of this invention was produced similar to that of Example 10. The composition of the melt was 0.19% Ti, 0.006% Al, 0.007% C, 0.13% Mn, 0.31% Si, 11.0% Cr, 0.16% Ni and 0.008% N. The ratio of the product of titanium and nitrogen divided by aluminum was 0.24. The steel melt then was transferred to a caster and cast into thin slabs in a manner similar to that described above for Example 5. This ferritic stainless steel having a ratio of (Ti×N)/Al≧0.23 resulted in an as-cast steel structure containing 100% fine equiaxed grains of a size of about 1 mm. The slabs of this steel contained inclusions primarily of titanium oxides.

These slabs were reheated to 1250° C., hot processed to a thickness of 3.0 mm with a finishing temperature of 800° C. and coiled at a temperature of 700° C. The hot processed sheets were descaled and pickled in nitric and hydrofluoric acid. The hot processed sheets were cold reduced 53% to a thickness of 1.4 mm. These hot processed sheets were not annealed prior to cold reduction. The cold reduced sheets were annealed at peak metal temperature of 940° C. for 10 seconds. After stretching, the ridging characteristic on the annealed sheets were 1–2 and had an $R_m$ of 1.39–1.48. A ridging characteristic of 2 means good ridging characteristics. Mechanical properties of the sheets of the invention are summarized in Table 7.

EXAMPLE 12

Another 130 mm thickness thin slab of the composition described in Example 11 was reheated to 1250° C., hot processed into sheets having a thickness of 4.1 mm with a finishing temperature of 830° C. and coiled at a temperature of 720° C. The hot processed sheets were descaled, pickled in nitric and hydrofluoric acid and then cold reduced 66%, 76% and 85% corresponding to thicknesses of 1.4, 1.0 and 0.6 mm respectively. These hot processed sheets of the invention were not annealed prior to cold reduction. The cold reduced sheets were annealed at peak metal temperature of 940° C. for 10 seconds. After stretching, the ridging characteristic on the annealed sheets generally was 2 or better and had an $R_m$ of 1.76–1.96. An $R_m$ of ≧1.7 is considered outstanding for ferritic stainless steel and previously was not believed to be possible for a ferritic stainless steel that was not given an anneal prior to cold reduction. Mechanical properties of the sheets of the invention are summarized in Table 8.

Figure 14:
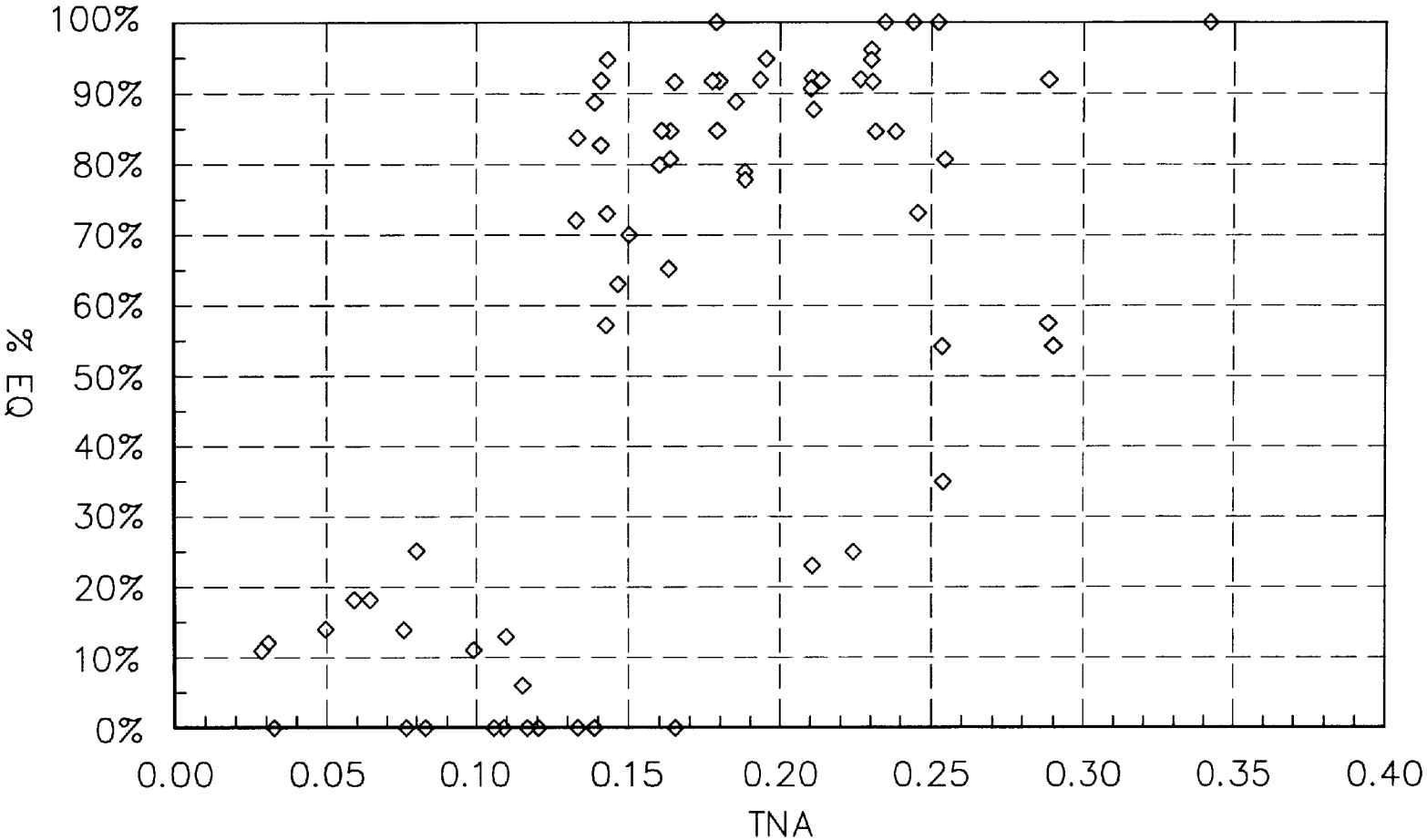
FIG. 14 is a graph illustrating the % equiaxed grains (% EQ) in the as-cast grain structure as a function of the ratio of the product of the weight percentages of titanium and nitrogen divided by aluminum (TNA) for continuous slabs cast from ferritic chromium alloyed steel.

The compositions, TNA and % EQ of the as-cast slabs for the comparative and inventive Type 409 stainless melts of Examples 5–11 above as well as additional comparative and inventive Type 409 stainless melts produced and cast into slabs in a manner similar to that described for Examples 5–11 are summarized in Table 2. The % EQ as a function of TNA for these slabs is shown in FIG. 14. FIG. 14 generally demonstrates the steels of the invention require Ti≧0.10% and a TNA, i.e., (Ti×N)/Al, of about 0.14 or more to obtain an as-cast steel structure containing greater than 50% fine equiaxed grains. The exceptions to this were one slab on Heat 980460, Heat 880459, Heat 880463, Heat 980655 and Heat 980687. Heats 980655 and 980687 experienced nozzle clogging problems, i.e., excessive alumina inclusions, and resulted in low tundish molten steel temperatures below 1545° C. Accordingly, the melts of the invention preferably are continuously cast having a super heat of at least 40° C., more preferably at least 55° C., to prevent the clustering of large alumina inclusions. Heat 880459 was reblown for excessive carbon after being deoxidized with titanium, i.e., titanium oxide inclusions probably removed to the slag. Nothing unusual for Heat 880463 was observed.

The compositions, TNA and % EQ for still other as-cast slabs for comparative and inventive Type 430, Type 439 and Type 439Mo high chromium stainless melts produced and cast similar to the slabs of Examples 5–11 are summarized in Table 4. Table 4 demonstrates that Ti of at least about 0.10% and a TNA, i.e., (Ti×N)/Al, of at least about 0.30 resulted in an as-cast steel grain structure generally containing well in excess of 50% fine equiaxed grains for high chromium alloyed steels.

One very important advantage of the present invention relates to a cold reduced, recrystallized annealed final product. Prior art ferritic stainless steels not only were adversely affected in appearance by ridging but also had poor formability, i.e., low $R_m$. One reason ferritic stainless steels have limited formability is because the structure after annealing consisted of non-uniform or "banded" large grains. FIG. 11 illustrates a typical non-uniform grain structure after annealing of a comparative prior art ferritic stainless steel having a ratio of the product of titanium and nitrogen divided by aluminum less than 0.14 and having an as-cast structure containing <50% equiaxed grains. This invention allows a fine equiaxed grain to be formed in the as-cast steel so that a fine uniform recrystallized grain structure can be consistently be formed after cold reduction. A ferritic chromium alloyed steel sheet having a fine, uniform recrystallized grain structure can be formed without annealing the steel prior to cold reduction and with only one cold reduction.

It will be understood various modifications may be made to this invention without departing from the spirit and scope of it. Therefore, the limits of this invention should be determined from the appended claims.

What is claimed is:

1. A chromium alloyed ferritic steel comprising Ti, N and Al in concentrations, by weight percentages, such that a ratio of (Ti×N)/Al<0.14 and the steel is deoxidized with a deoxidizer consisting essentially of titanium and having an as-cast structure <50% equiaxed grains.

2. The chromium alloyed ferritic steel of claim 1 wherein the steel is substantially free of ridging after forming.

3. The steel of claim 1 wherein the concentration, by weight percent, of Ti is at least about 0.1%, of N is less than about 0.05%, and of Al is less than about 0.03%.

4. The steel of claim 3 wherein Ti and N are in sub-equilibrium amounts and Ti satisfies the relationship (Ti/48)/[(C/12)+(N/14)]<1.5.

5. The steel of claim 3 wherein the N is 0.005 to less than 0.02%.

6. The steel of claim 1 wherein the equiaxed grains have a size ≦3 mm.

7. The steel of claim 1 wherein the Al is 0.003–0.02%.

8. The steel of claim 7 further comprising up to about 1% by weight percent an element from the group consisting of niobium, zirconium, tantalum and vanadium.

9. The steel of claim 1 including <5 to about 200 ppm B.

10. The steel of claim 7 wherein O is 10–60 ppm.

11. The steel of claim 1 wherein the ratio of (Ti×N)/Al≧0.23 and the as-cast structure is substantially free of columnar grains.

12. The steel of claim 7 wherein the as-cast structure is ≧60% equiaxed grains.

13. The steel of claim 1 wherein the as-cast steel has inclusions comprising titanium with a majority of said inclusions having a size <1.5 μm.

14. The steel of claim 1further comprising at least about 16-about 25% Cr, by weight percent, and the ratio of (Ti×N)/Al≧0.30.

15. The steel of claim 1 wherein, the steel is given a recrystallization anneal, the annealed steel has a rm value of ≧1.4.

16. The steel of claim 10 wherein, the steel is given a recrystallization anneal, the annealed steel has a rm value of ≧1.7.

17. A chromium alloyed ferritic steel comprising:

≦0.020% Al, 0.10–0.30% Ti, ≦0.02% C, ≦1.50% Mn, 0.005–0.012% N, ≦1.5% Si, 8–25% Cr, <2.0% Ni, a sub-equilibrium amount of Ti, the ratio of (Ti×N)/Al>0.16, all percentages by weight, the balance Fe and residual elements, the steel after being recrystallization annealed having a rm value of ≧1.4 and being substantially free of ridging after forming, the annealed steel cold reduced from hot processed steel not previously annealed prior to cold reduction, and the hot processed steel formed from a steel deoxidized with deoxidizer consisting essentially of titanium and having an as-cast structure ≧80% equiaxed grains.

18. A process for making chromium alloyed steel comprising the steps of:

providing a chromium alloyed ferrous steel melt comprising Ti, N, and Al, deoxidizing the melt with a deoxidizer consisting essentially of Ti in an amount of Ti, by weight percentage, satisfying the relationship (Ti×N)/Al>0.14, all by weight percentage, casting the melt into a steel having an as-cast structure ≧50% equiaxed grains, hot processing the steel, descaling the steel, cold reducing the steel to final thickness, and recrystallization annealing the cold reduced steel wherein the annealed sheet is substantially free of ridging after forming.

19. The process of claim 18 wherein Al is 0.003–0.02%, Ti is 0.1–0.6%, (Ti×N)/Al is ≧0.23 and satisfies the relationship (Ti/48) [(C/12)+(N/14)]>1.5.

20. The process of claim 18 wherein the steel is continuously cast into a thin slab having a thickness <140 mm, and further comprising:

reheating the slab to a temperature of 1050–1300 C. prior to hot deforming the slab.

21. The process of claim 18 wherein the cold reducing on the hot processed steel is without prior annealing.

22. The process of claim 21 wherein the cold reducing is in a single stage.

23. The process of claim 18 wherein the recrystallization annealing is at a temperature of 800–1000° C. for at least 1 second.

24. A chromium alloyed ferritic steel comprising:

≦0.08% C, at least about 8% to about 25% Cr, ≦1.5% Mn, ≦0.05% N, 0.003–0.03% Al, ≦1.5% Si, <2.0% Ni, about 0.1–1.0% Ti, 10–60 ppm O, ≦0.002% Ca, Ti, N and Al in concentrations, by weight percentages, such that a ratio of (Ti×N)/Al≧0.14, the balance Fe and residual elements, and the steel is deoxidized with a deoxidizer consisting essentially of titanium and having an as-cast structure >50% equiaxed grains.

25. The process of claim 18 wherein the cold reducing of the hot processed sheet is in a single stage.

26. The process of claim 18 wherein the recrystallization annealing is at a temperature of 800–1000° C. for at least 1 second.

27. A process for making chromium alloyed steel, comprising the steps of:

providing a steel containing ≦0.013% Al, 0.15–0.25% Ti, ≦0.02% C, ≦1.50 Mn, 0.005–0.012% N, ≦1.5% Si, 8–25% Cr, <2.0% Ni, the ratio of (Ti, ×N)/Al≧0.16 and (Ti/48)/[(C/12)+(N/14)]>1.5, a sub-equilibrium amount of Ti, all percentages by weight, the balance Fe and residual elements, casting the melt into a steel having an as-cast structure ≧80% equiaxed grains, hot processing the steel into a sheet, descaling the sheet, cold reducing the sheet to a final thickness without prior annealing, and recrystallization annealing the cold reduced sheet wherein the annealed sheet is essentially free of ridging when formed into a part.

* * * * *

UNITED STATES PATENT AND TRADEMARK OFFICE

CERTIFICATE OF CORRECTION

PATENT NO. : 6,855,213 B2
APPLICATION NO. : 09/153822
DATED : February 15, 2005
INVENTOR(S) : Yoshitake et al.

It is certified that error appears in the above-identified patent and that said Letters Patent is hereby corrected as shown below:

Column 23, Claim 1, line 17, after "...(TixN)/Al", please delete "<" and replace with, -->--.

Column 23, Claim 1, line 19, after "...structure", please delete "<" and replace with -->--.

Column 23, Claim 4, line 27, after "...[C/12)+(N/14)]", please delete "<" and replace with -->--.

Column 23, Claim 9, line 35, after "...including", please delete "<" and replace with -->--.

Column 23, Claim 10, line 36, please delete "The steel of claim 7 wherein O is 10-60 ppm." and replace with -- The steel of claim 1 wherein the as-cast structure is ≥ 80% equiaxed grains.--

Column 23, Claim 12, lines 40-41, please delete "The steel of claim 7 wherein the as-cast structure is ≥ 60% equiaxed grains." And replace with --The steel of claim 11 wherein the Al ≤ 0.010.--.

Column 24, Claim 27, line 50, after "providing a steel" and before "containing", please insert --melt--.

Column 24, Claim 19, line 21, after "...(Ti/48)" and before "[(C/12)+(N/14)]>1.5.", please insert --/--.

Signed and Sealed this

Fourteenth Day of August, 2007

JON W. DUDAS
*Director of the United States Patent and Trademark Office*